US005486854A

United States Patent [19]

Uchida

[11] Patent Number: 5,486,854

[45] Date of Patent: Jan. 23, 1996

[54] INK JET RECORDING APPARATUS

[75] Inventor: Haruo Uchida, Yokohama, Japan

[73] Assignee: Canon Kabushiki Kaisha, Tokyo, Japan

[21] Appl. No.: 942,419

[22] Filed: Sep. 9, 1992

[30] Foreign Application Priority Data

| | | | |
|---|---|---|---|
| Sep. 11, 1991 | [JP] | Japan | 3-259724 |
| Jan. 16, 1992 | [JP] | Japan | 4-025728 |

[51] Int. Cl.[6] ..... B41J 2/165

[52] U.S. Cl. ..... 347/30; 347/24; 417/477.3; 417/477.8; 417/62

[58] Field of Search ..... 346/140 R; 417/62, 417/410 B, 410 C, 410 D, 475, 477.1–477.14, 410.1, 410.5; 347/22, 30, 31, 32, 84, 85

[56] References Cited

U.S. PATENT DOCUMENTS

| | | | |
|---|---|---|---|
| 3,876,340 | 4/1975 | Thomas | 417/475 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,834,630 | 5/1989 | Godwin | 417/475 |
| 4,997,347 | 3/1991 | Roos | 417/475 |
| 5,138,343 | 8/1992 | Aichi et al. | 347/30 |

FOREIGN PATENT DOCUMENTS

| | | | |
|---|---|---|---|
| 0424859 | 5/1991 | European Pat. Off. | 347/30 |
| 436756 | 7/1991 | European Pat. Off. . | |
| 0499484 | 8/1992 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 3-193461 | 8/1991 | Japan | 347/30 |
| 2140746 | 12/1984 | United Kingdom . | |
| 2206847 | 1/1989 | United Kingdom . | |

OTHER PUBLICATIONS

A. Vesci, "Multiple Harmonic, Flex Piston, Radial Bellows Pump", IBM Technical Disclosure Bulletin, vol. 23, No. 2, Jul. 1980.

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet recording apparatus for forming a record by discharging ink from a recording head onto a recording material, has a tube pump for ink discharge recovery, by suction or pressurization, through deformation, with pressure rollers, of plural tubes communicating with discharge openings of the recording head. The timings of pressing of the tubes by the pressure rollers or the timings of release of the tubes from the pressed state by the pressure rollers are different from tube to tube.

4 Claims, 14 Drawing Sheets

INK JET RECORDING APPARATUS

BACKGROUND OF THE INVENTION

1. Field of the Invention

The present invention relates to an ink jet recording apparatus for forming a record by discharging ink from recording means to a recording material.

2. Related Background Art

Recording apparatus constructed as a printer, a copying machine or a facsimile, or employed as the output unit for a work station or an integral electronic equipment including a computer or a word process, is designed to record an image on a recording material (recording medium) such as paper or a plastic sheet. Such recording apparatus can be classified, by the recording system, for example as ink jet printers, wire dot printers, thermal printers, laser beam printers etc.

In the recording apparatus of the serial scanning type, in which main scanning is conducted in a direction perpendicular to the transporting direction (sub scanning direction) of the recording material, the recording thereon is achieved, after said recording material is set in a predetermined recording position, by repeating the operations of recording a line image with recording means (generally supported by a carriage) moving along said recording material (main scanning operation), advancing the recording material by a predetermined amount (transportation of recording material), and recording the image of a next line on the recording material when it is stopped again. On the other hand, in the recording apparatus of the line type in which the recording is achieved solely by sub scanning in the transporting direction of the recording material, the recording thereon is achieved, after the recording material is set in a predetermined recording position, by repeating the operations of collectively recording a line image, then advancing the recording material by a predetermined amount, and collectively recording the next line.

Among various recording apparatus mentioned above, an ink jet recording apparatus, forming a record by discharging ink from recording means (recording head) onto a recording material, has the advantages of easy size reduction of the recording means, capability of high-speed recording of a fine image and for recording on plain paper without any special treatment, low running cost, low noise level because of non-impact recording, and easy recording of a color image with inks of plural colors. Particularly a line-type apparatus, employing line-type recording means, having an array of plural discharge openings along the transverse direction of the recording material, can attain a higher recording speed.

In particular, an ink jet recording head utilizing thermal energy for ink discharge can be manufactured with a higher density of discharge openings, by the formation of electrothermal converters, electrodes, liquid path walls, cover plates etc. on a substrate, utilizing the steps common in the semiconductor process, such as etching, evaporation sputtering etc., whereby further compactization can be realized. Also various requirements exist for the materials used for the recording medium, and it is recently desired to form recording not only on ordinary paper and plastic sheet (for overhead projectors, but also on thin paper and worked paper such as punched paper for filing, paper with roulette holes, paper of arbitrary size etc.

Such ink jet recording apparatus employs, for maintaining a proper discharge state of the recording head or restoring the proper discharge state in case the discharge openings of said head are clogged, recovery means involving a recovery pump for sucking ink out of the discharge openings by a negative pressure generated by said pump. A tube pump, generating a negative pressure by a volume change in a flexible tube, is often utilized as such a recovery pump and has the advantages of a simple structure, a low cost, a small size and a light weight.

FIGS. 17 and 18 are vertical cross-sectional views of a conventional tube pump, respectively at the start and end of tube pinching. On a discharge opening face 51 of a recording head 1, the aperture of a cap 2 is maintained in contact to seal a discharge opening 52. On a rear aperture of the cap 2, there is connected a tube 3 which extends to the tube pump 4. Said tube pump 4 is composed of a pump base 5, rotatably supporting a guide roller 6, which in turn rotatably supports a pressure roller 7. In more details, a shaft 8 of the pressure roller 7, for pressing the tube 3, is rotatably supported by the guide roller 6, of which shaft 9 is rotatably supported by the pump base 5. The pump base 5 is provided with an arc-shaped groove 10, concentric with the shaft 9 of the guide roller 6, for accommodating the tube 3. At the other end, at the downstream side, of the tube 3, there is provided a used tank reservoir 11 for storing the ink sucked from the discharge opening 52.

When the guide roller 6 is rotated in a direction a by drive means (not shown), the pressure roller 7 provided on the guide roller 6 comes into contact with the tube 3 at a position X shown in FIG. 17, thereby pressing the tube 3 until the internal space thereof at the pressed portion becomes zero. When the guide roller 6 is further rotated in said direction a from this state, the pressure roller 7 effects rotation in a direction b while continuously pressing the tube 3 and making revolution in the direction a. The pump temporarily stops when the pressure roller 7 reaches a position Y shown in FIG. 18, and the negative pressure, generated by the volume change in the tube 3 based on the pressing by the roller 7 between the positions X and Y acts on the discharge opening 52 of the recording head 1, thus sucking the ink out of said opening. The sucked ink is forwarded in succession to said used ink reservoir 11.

In case plural recording heads 1 are employed, as in a color ink jet recording apparatus, there are provided plural tubes 3 corresponding to the number of the recording heads 1, and the guide roller 6 is given plural pressure rollers 7 corresponding to the number of said tubes 3. In the conventional ink jet recording apparatus with plural recording heads, in order to provide said recording heads with a same suction force, the distances from the recording head 1 to the X and Y positions have to be same for every tube 3, and the pressure roller 7 has to be mounted on the guide roller 6 so as to come into contact with and to detach from the tube 3 at a same timing.

In such conventional configuration, however, in case the motor for the pump is also used for paper advancement or for carriage drive for the purpose of compactization or cost reduction of the entire apparatus, there may result a synchronization failure in the motor, an instability in the precision of paper advancement or an unevenness in the recorded image in the scanning direction of the carriage, leading to the deterioration of the recorded image quality, due to a torque fluctuation generated at the moment when the pressure roller 7 presses the tube 3 or is released therefrom.

Also in the conventional configuration, the pressure rollers 7 press the tubes 3 at a same timing. However, since the torque required for pump driving becomes largest at the moment when the pressure roller 7 starts to press the tube 3, the pump driving maximum torque increases at such moment in proportion to the increase of the number of the tubes 3 and the pressure rollers 7, whereby there is required a larger motor with an increased cost.

Furthermore, in the above-explained conventional configuration, the pump may be driven by a driving power source for other purpose, such as for transporting the recording material, used both in the forward and reverse directions. In case the guide roller 6 shown in FIG. 17 is reversed in a direction f, and if ink discharged from the recording head 1 by suction in the forward driving and not having reached the used ink reservoir 11 remains in the tube 3, said ink flows inversely toward the cap 2, thus overflowing therefrom, or sticking onto the discharge opening face of the head or mixing with the ink in said discharge opening, thus eventually inducing recording failure.

In order to avoid such drawback, there is conceived a method of rotating, after the sucking operation, the guide roller 6 in the direction a in the uncapped state, in order to move the sucked ink toward the used ink reservoir 11 as much as possible. However, if said reservoir 11 is distant from the tube pump 4, the guide roller 6 has to be rotated considerably in the direction a, so that the recovery operation becomes very long. On the other hand, said reverse flow of ink can be avoided by employing an exclusive driving power source, rotating only in direction, for the tube pump 4, but such method elevates the cost and increases the volume of the apparatus.

SUMMARY OF THE INVENTION

In consideration of the foregoing, an object of the present invention is to provide an ink jet recording apparatus which can reduce the size, weight and cost of the driving motor even in case of employing plural tubes by dispersing the torque required for pressing said tubes by the pressing rollers, which can also achieve gradual torque variation to a maximum value by dispersing the torque variation at the moment when the tube is pressed or released from the pressed state, and which allows to use the driving power source for sheet advancement or for carriage driving also for the pump driving without generating unevenness in the sheet advancement or in the main scanning, by avoiding desynchronization of the motor, thereby enabling compactization and cost reduction of the recording apparatus.

Another object of the present invention is to provide an ink jet recording apparatus for forming a record by discharging ink from recording means onto a recording material, provided with a recovery pump for effecting suction or pressurization by deforming plural tubes, communicating with the discharge openings of the recording means, with pressing rollers, wherein the timing of tube pressing by the pressure roller or the timing of release of the tube from the pressure roller is made different from tube to tube.

Still another object of the present invention is to provide an ink jet recording apparatus provided with a suction pump for ink discharge recovery, which is capable of improving the image quality by preventing the ink reverse flow, and also improving the service life of tubes and the reliability of pump, by avoiding reverse rotation of the pump.

Still another object of the present invention is to provide an ink jet recording apparatus for forming a record by discharging ink from recording means onto a recording material, provided with a tube pump for ink discharge recovery by generating a negative pressure at the discharge opening of the recording means through deformation of a tube, communicating with said discharge opening, by a pressure roller, wherein the driving force is transmitted to said pressure roller only in a direction for generating the negative pressure at said discharge opening.

In addition to the foregoing, there may be employed a configuration including a one-way clutch between said tube pump and the driving power source therefor, or a configuration provided, between said driving power source and the tube pump, with a transport roller bearing, on the shaft thereof, with a clutch spring which impinges, at an end thereof, on a part of a gear on said shaft, whereby said clutch spring is tightened to transmit the driving force to the tube pump when the transport roller is rotated in a direction to generate the negative pressure at the discharge opening, but said spring is loosened to prevent the driving force from being transmitted to the tube pump when the transport roller is rotated in the opposite direction. The above-mentioned objects can be attained more efficiently by these configurations.

DESCRIPTION OF THE PREFERRED EMBODIMENTS

Now the present invention will be clarified in detail by embodiments thereof shown in the attached drawings. FIG.

1 is a perspective view showing the principal part of an embodiment of the ink jet recording apparatus of the present invention. In said apparatus, a recording material 12 is intermittently advanced in a predetermined direction by a transporting (sub scanning) mechanism, and the recording is achieved by moving a recording head (recording means) 1 in a crossing direction.

Figure 1:
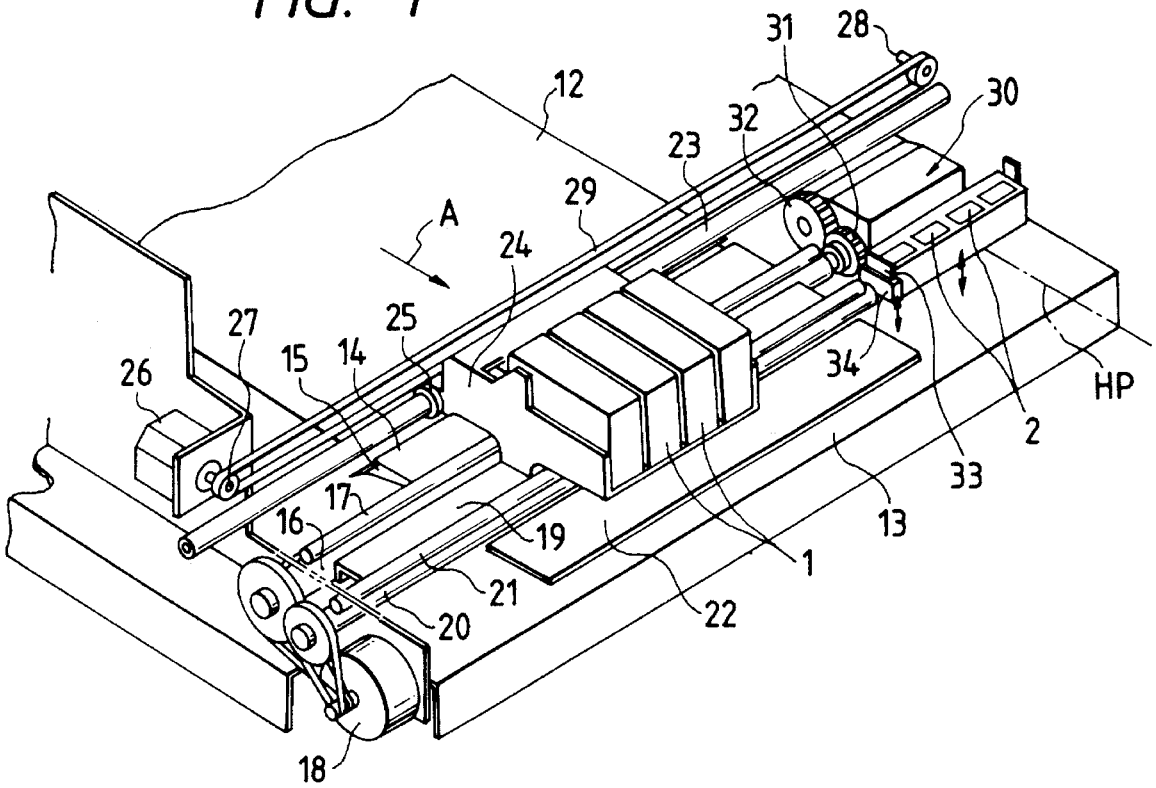
FIG. 1 is a perspective view of the principal part of an embodiment of the ink jet recording apparatus of the present invention.

Referring to FIG. 1, a recording material 12, for example paper or a plastic sheet, is transported in a direction A by a sheet feeding device (not shown), then guided between an upper guide 14 and a lower guide 15 fixed on a bottom plate 13, and enters the nip of paired transport rollers, consisting of a transport (sub scanning) roller 16 and an idler roller 17 driven by a transport motor 18. Through the drive by said paired rollers 16, 17, the recording material 12 is transported on a platen 19 fixed on the bottom plate 13, and reaches the nip of paired discharge rollers consisting of a discharge roller 20 and an idler roller 21 while being supported by said platen 19, and the advancement is once interrupted when the material reaches said nip. Said paired rollers 20, 21 are driven by said motor 18 in synchronization with the paired transport rollers 16, 17.

A sheet discharge guide 22 is supported on the bottom plate 13, and the recording material 12, transported in the direction A by said paired discharge rollers 20, 21, is guided by said guide 22 to the outside of the apparatus. On the surface of the transport roller 16 and the discharge roller 20, aluminum particles of a particle size of 1000–2000 are adhered, and chloroprene rubber is thermally adhered to the idler rollers 17, 21, so that the recording material 12 can be transported with a large transporting power and with a high precision.

Above and behind the platen 19, a main scanning rail (guide rail ) 23 is fixed, parallel to the axial direction of the transport roller 16. Said recording head 1 is mounted on a carriage 24, which is rendered movable along said guide rail 23 by inserting it into a bearing 25 of said carriage 24. The recording head 1 of the present embodiment, mounted on the carriage 24, is composed of plural (four) recording means utilizing different inks, for example of black, cyan, magenta and yellow in case of full-color recording. Also each recording head in the present embodiment is of cartridge type integrally including an ink tank and a recording unit (ink discharge unit), and is replaceable mounted on the carriage 24.

Under each recording head 1 there is formed an ink discharge face on which plural discharge openings are arranged in a direction crossing the moving direction of the carriage 24. Each ink discharge face is so positioned as to discharge ink toward the platen 19, through a lower aperture of the carriage 24. Said recording head 1 is capable of discharging ink by thermal energy, and is provided with electrothermal converters for generating thermal energy. More specifically, said recording head 1 effects recording by ink discharge through the discharge openings, utilizing film boiling phenomenon induced by thermal energy applied by said electrothermal converters.

Figure 2:
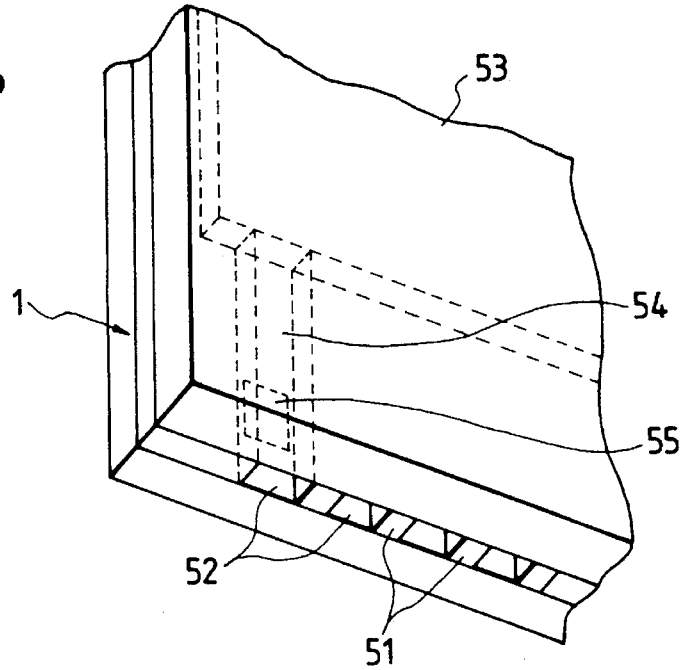
FIG. 2 is a partial perspective view schematically showing the structure of an ink discharge portion of the recording means shown in FIG. 1.

FIG. 2 is a partial perspective view, schematically showing the structure of the ink discharge portion of the recording head 1, wherein, on the discharge opening face 51 opposed to the recording material 12 with a predetermined spacing for example of about 0.5 to 2.0 mm, there are formed plural discharge openings 52 with a predetermined pitch, and an electrothermal converter 55 (such as a heat-generating resistor) for generating thermal energy for ink discharge is provided along the wall of a liquid path 54 which connects each discharge opening 52 with a common liquid chamber 53. In the present embodiment, the recording head 1 is so mounted on the carriage 24 that said discharge openings 52 are arranged perpendicularly to the moving direction (main scanning direction) of the carriage 24. Thus, based on image signals or discharge signals, the electrothermal converters 55 are selectively energized to induce film boiling in the ink in the liquid paths 54, and the ink is thereby discharged from said discharge openings.

Again referring to FIG. 1, a carriage (main scanning) motor 26, for reciprocating the carriage 24 is mounted on a main frame of the apparatus, and is provided with a motor pulley 27 integrally rotating with the shaft of said motor. At the opposite side there is rotatably provided an idler pulley 28, and a main scanning belt 29 is supported between said motor pulley 28 and idler pulley 29 and is connected to the carriage 24, which can therefore be reciprocated by the rotation of the carriage motor 26.

A home position HP of the carriage 24 is defined within the movable range thereof but outside the recording range (or outside the platen 19). In the vicinity of said home position HP, there are provided caps 2 of rubber-like elastic material, capable of capping the discharge opening faces of the recording heads. Also in the vicinity of said caps 2, there is provided a recovery unit 30 for resolving discharge failure, resulting for example from the blocking of the discharge openings 52 of the recording heads 51. Said recovery unit 30 is designed to apply a negative pressure to the openings 52, while the discharge opening face 51 is covered by the caps 2, thereby sucking bubbles, solidified ink, dust etc. together with the ink from the openings 52.

Under the carriage 24 there are rotatably supported rollers (not shown), which rotate on the recording material 12 on the platen 19, thereby maintaining a constant distance between the discharge opening face 51 of the recording heads 1 and the recording face of the recording material 12. Since the aforementioned caps 2 are provided in the vicinity of the home position HP of the carriage 24, the platen 19 cannot be extended to said home position HP. For this reason, when the carriage 24 moves toward said home position HP, said roller of the carriage 24 comes out of the platen 19, and, in such state, the carriage 24 is supported, through said roller, by a guide plate (not shown) provided on said recovery unit 30.

At the recording operation, the carriage 24 is moved by the carriage motor 26, and the recording head 1 is driven according to the image signal, thereby discharging ink onto the recording material 12 stopped on the platen 19 and forming the image of a line (main scanning). After the recording of a line, the paired transport rollers 16, 17 are rotated to move the recording material 12 by a predetermined amount (for example an amount corresponding to the height of a line) (sub scanning), and the carriage 24 and the recording head 1 are activated again to record a next line (main scanning).

Thereafter these main and sub scanning operations are alternately repeated to record the image over the entire recording material 12. Then, when the rear end of the recording material 12 is detected by a sensor (not shown) at a predetermined position, the recording operation is terminated and the paired discharge rollers 20, 21 are rotated to discharge the recording material 12 along the discharge guide 22 to the outside of the apparatus.

Four recording heads 1 consists of ink tanks respectively strong inks of yellow, magenta, cyan and black, and ink discharge units for discharging said inks and respectively connected to said ink tanks. According to the color separated image signals, said ink discharge units respectively discharge said inks of four colors, which are superposed to form a full color image. The recording material 12 is not only supplied from a sheet feeding device, but may also be fed by manual insertion, in which the operator inserts a recording material into the nip of the discharge rollers 20, 21 and inversely rotates the motor 18, whereby the material is introduced into the sheet feeding unit from the discharge side and is again fed from said sheet feeding unit.

Said caps 2 maintain the interior of the discharge openings 52 of the recording heads 1 in a wet state, thereby preventing the blocking of said openings, resulting from ink drying or ink adhesion. A tube pump 4 (FIGS. 3 to 6) in the recovery unit 30 is connected to the caps 2, and is activated when the discharge opening faces 51 are covered by the caps 2, thereby eliminating the bubbles, solidified ink, dust etc. by suction together with the ink from the discharge openings 52, and thus resolving the discharge failure. In the ink jet recording apparatus shown in FIG. 1, the ink suction from the discharge openings 52 of the plural (four) recording heads 1 is executed by the tube pump 4 (FIGS. 3 to 6) provided with plural (four) tubes 3 for converting the rotary driving force into a negative pressure.

Between the platen 19 and the caps 2, there is provided a cleaning member 33, consisting of an elastic blade, for wiping off the ink drops and dust deposited on the discharge opening faces 51 of the recording heads 1. Said cleaning member 33 is supported by a holder 34, and is rendered movable, by a driving source (not shown), between a protruding position capable of contacting with the discharge opening faces 51 and a retracted position separate therefrom.

Figure 3:
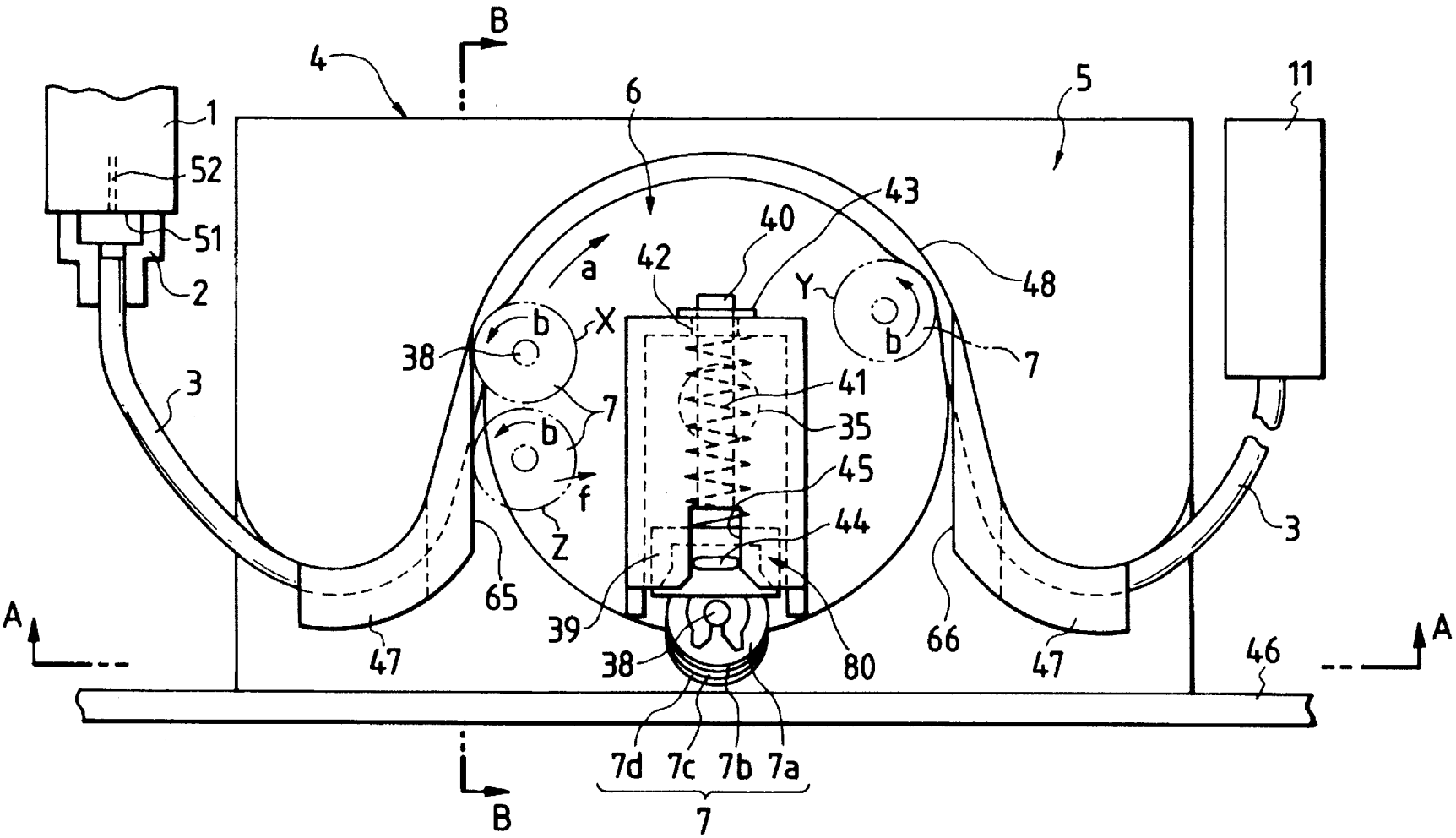
FIG. 3 is a vertical cross-sectional view of an embodiment of the tube pump of the present invention.
Figure 4:
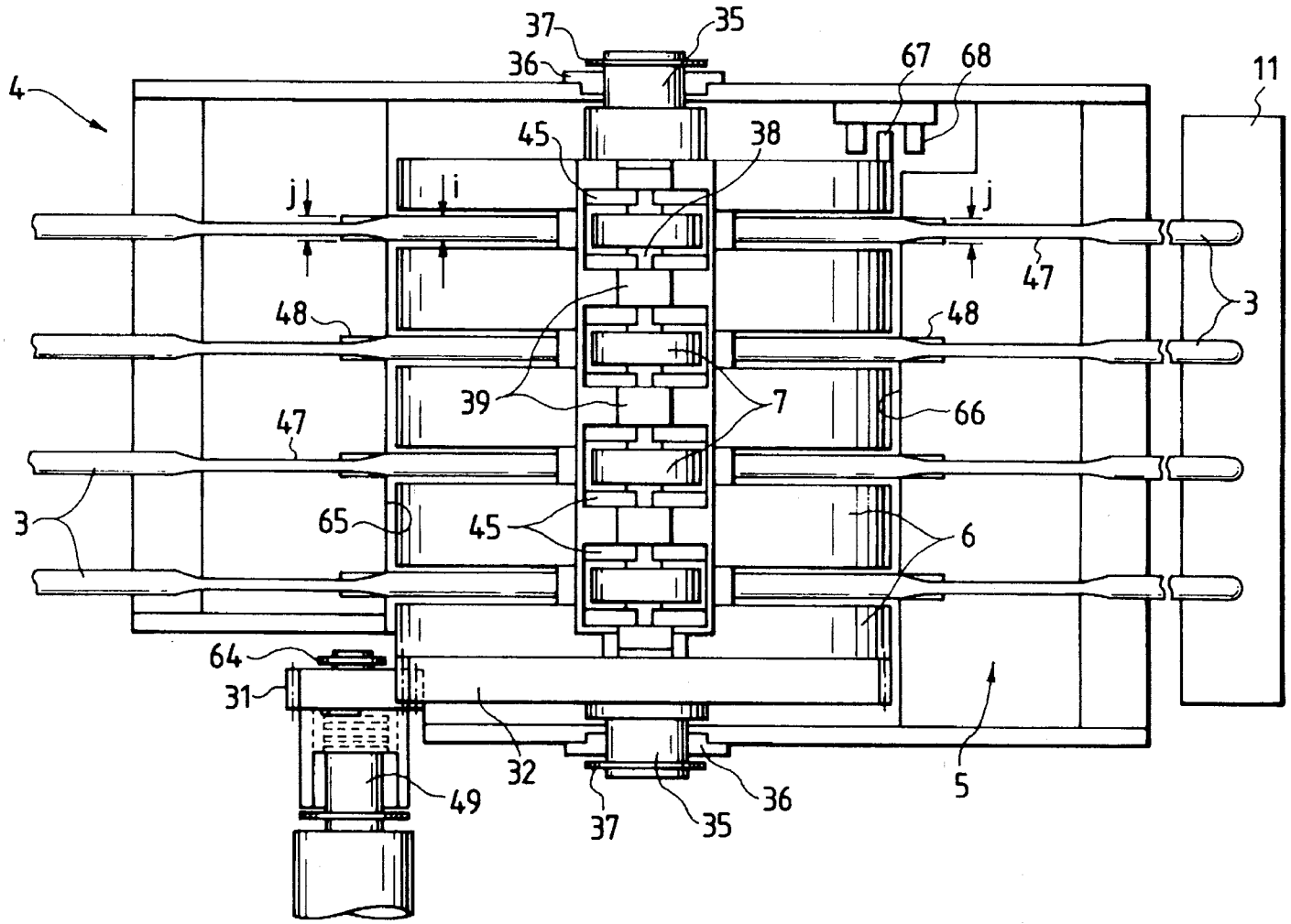
FIG. 4 is a cross-sectional view of said tube pump, seen from below, along a line A—A in FIG. 3.
Figure 5:
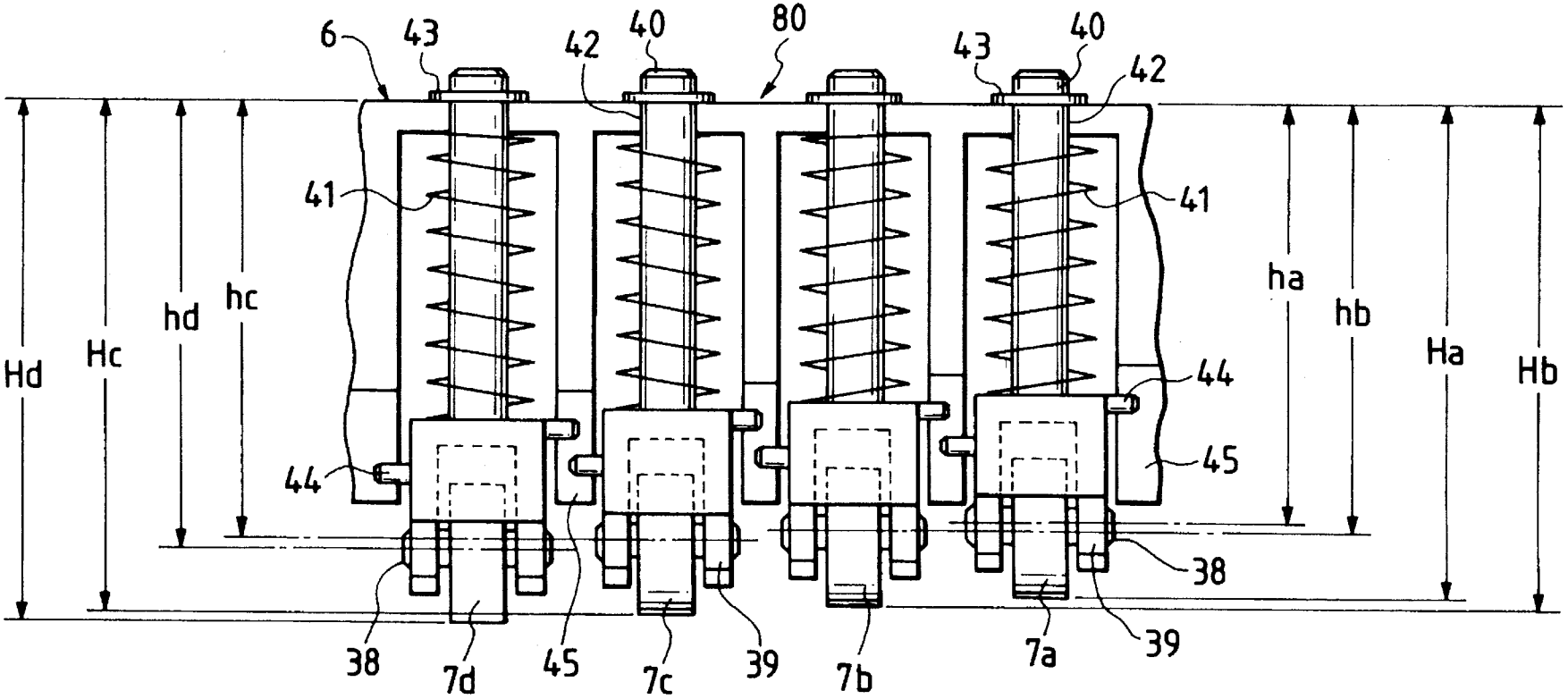
FIG. 5 is a partial cross-sectional of the tube pump, seen from a line B—B in FIG. 3.
Figure 6:
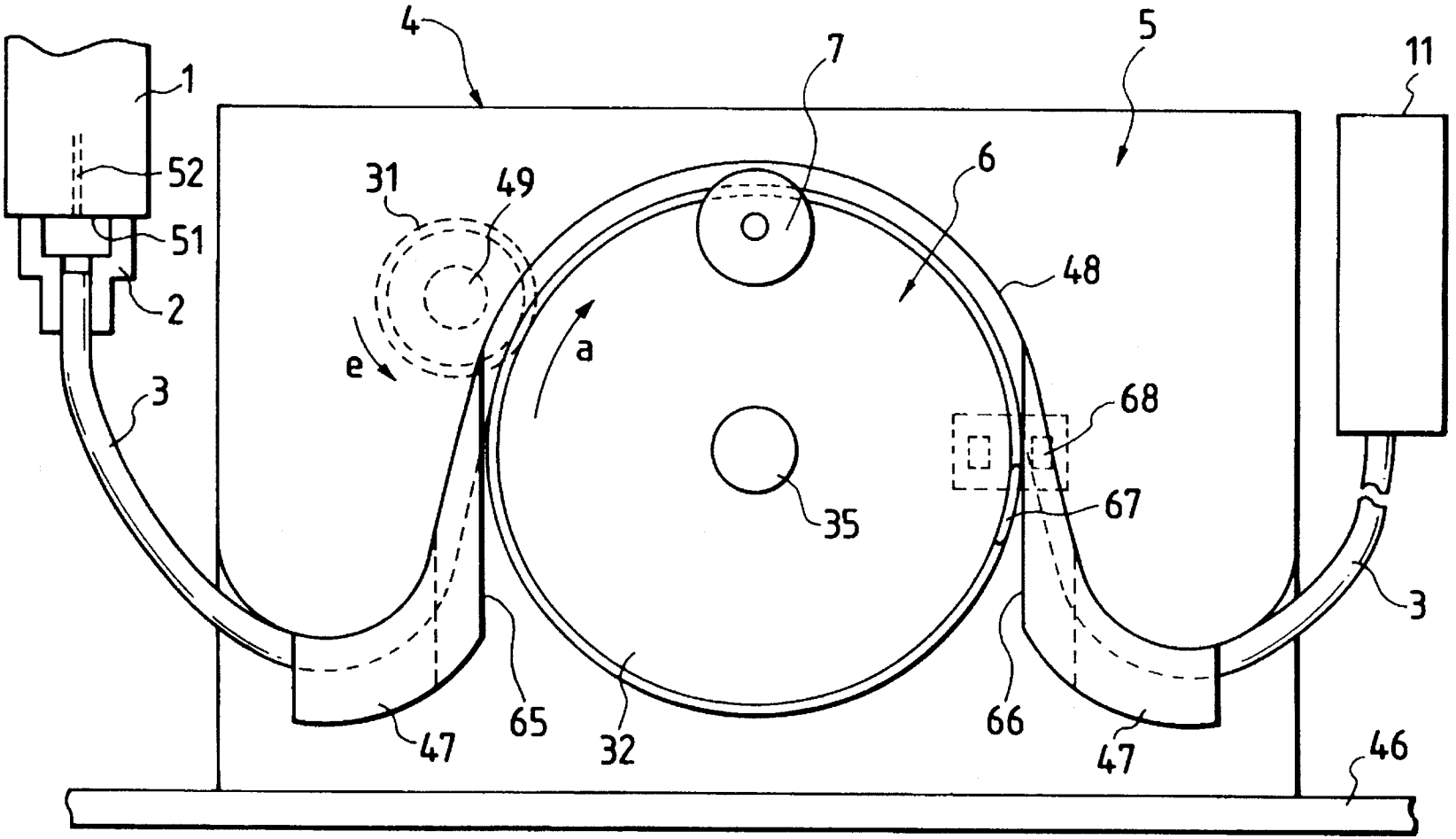
FIG. 6 is a partially cut-off lateral view showing the function of the tube pump shown in FIG. 3.

FIG. 3 is a schematic vertical cross-sectional view of an embodiment of the tube pump 4 of the present invention; FIG. 4 is a plan view seen from below, at a line A—A in FIG. 3; FIG. 5 is a partial elevation view seen from a line B—B in FIG. 3; and FIG. 6 is a schematic vertical cross-sectional view showing the function of said tube pump 4 shown in FIG. 3.

The tube pump 4, shown in FIGS. 3 to 6, effects ink discharge recovery by suction or pressurization, achieved by deforming plural (four) tubes 3, communicating with the discharge openings 52 of the recording heads 1, by means of pressure rollers 7, and is so designed that the timing when the tube 3 is pressed by or released from the pressing roller 7 is different from tube to tube. In case the blocking occurs (or is anticipated to occur) in the discharge openings 52 of the recording head 1, the recovery operation by suction of the recording heads 1 is conducted in a non-recording position, for example in the home position HP.

In the non-recording position, the apertures of the caps 2 are brought into contact with the discharge opening faces 51 of the recording heads 1, thereby closing the discharge openings. Flexible tubes 3, connected to rear holes of the caps 2, extend to the tube pump 4. Said tube pump 4 is composed of a pump base 5 rotatably supporting a guide roller 6, which in turn rotatably supports pressure rollers 7. In the present embodiment, corresponding to the number (four) of the recording heads 1, there are provided four sets of the cap 2, tube 3, pressing roller 7 and supporting mechanism therefor, as shown in FIGS. 4 and 5.

Referring to FIGS. 3 to 6, the shaft 35 of the guide roller 6 is rotatably mounted in a bearing 36 of the pump base 5, and an E-ring 37 is mounted for maintaining said shaft 35 in the bearing 36. The pressure roller 7, for pressing the tube 3, is rotatably supported by a shaft 38 thereof fitted in a roller bearing 39. Said roller bearing 39 is mounted, together with a vertical shaft 40 and a compression spring 41, in a hole 42 formed in the guide roller 6, and is maintained in position by an E-ring 43. Said pressure roller 7 is biased by said compression spring 41 to press the tube 3.

The roller bearing 39 is positioned by positioning pins 44 thereof being guided by guide grooves 45 formed in the guide roller 6, and by the aforementioned vertical shaft 40 being guided by a guide hole 42 of the guide roller 6. In order to minimize the space of the tube pump 4, the positioning pins are alternated in height, as shown in FIG. 5, and are overlappingly positioned in the guide grooves 45.

Said pump base 5 is provided with an arc-shaped groove 48 concentric with the shaft 35 of the guide roller 6. The pump base 5 is mounted to the base 46 of the apparatus, in such a manner that the apertures of the arc-shaped groove 48 are positioned downwards. In this manner the pump base 5 functions as a cover, enclosing the moving parts when said pump base 5 is mounted, thereby preventing eventual contact of the user with or intrusion of foreign matter into the moving parts. The tube 3 is pinched and fixed in tube fixing grooves 47, formed in front of and behind the guide roller 6 on the pump base 5. The downstream end of said tube is connected to a used ink reservoir 11, for storing the ink sucked out of the discharge openings 52.

Referring to FIG. 6, a gear 31 for driving the tube pump 4 is provided on a shaft 49 and meshes with a driven gear 32 provided on the shaft 35 of the guide roller 6. When the driving gear 31 is rotated in a direction e, the driving force is transmitted to the driven gear 32, whereby the guide roller 6 is rotated in a direction a. If the pressure roller 7 is in contact with the tube 3, it is also rotated in a direction b shown in FIG. 3. Said shaft 49 is provided with a stopper 64 for maintaining said driving gear 31 in position.

In the above-explained structure, when the driving gear 31 is rotated by a driving power source (not shown), the guide roller is rotated in the direction a, through the driven gear 32. The shaft 49 supporting said driving gear 31 can be, for example, the shaft of the transport roller 16 (FIG. 1) for transporting the recording material 12, or a shaft rotating in synchronization therewith. Also there may be employed another rotary part or driving power source in the recording apparatus, such as a driving system for the carriage 24.

Upon rotation of the guide roller 6 in the direction a, the pressure roller 7 supported thereon comes into contact with a roller guide 65, formed integrally with the tube fixing groove 47 at the upstream side of the pump base 5, as indicated by a position Z in FIG. 3. The pressure roller 7, being guided by the roller guide 65, moves in a direction f while rotating in a direction b, until it reaches a position of pressing the tube 3.

Upon further rotation of the guide roller 6 in the direction a, the pressure roller 7 presses the tube 3 while rotating in the direction b, and crushes the tube until the internal space becomes zero in the course of movement to a position X. In the course of movement (revolution) from Z to X, the pressure roller 7 is guided by the roller guide 65 and moves in the direction f for compressing the spring 41, while deforming the tube 3. Consequently the driving torque of the tube pump 4 increases during the movement from Z to X.

Said tube fixing groove 47 has a larger width in the vicinity of said roller guide 65, in order to prevent, at the start of contact of the pressure roller 7 with the tube 3, the reactive force of thus deformed tube from being transmitted to the pressure roller 7. More specifically, the width j of the groove 47 in the vicinity of the roller guide 65 is larger than that i of the tube when it is pressed by the pressure roller 7. However, since the roller guide 65 has to guide the pressure roller 7, the groove width j in the vicinity of said roller guide 65 is made smaller than the thickness (width) of said roller 7 in order that said roller 7 does not fall into the groove 47.

Upon further rotation (revolution) of the guide roller in the direction a, the pressure roller 7 moves with the rotation in the direction b, while crushing the tube 3, and the pressure roller 7 temporarily stops at a position Y shown in FIG. 3. In this state a negative pressure is generated at the discharge openings 52 of the recording head 1, because of the volume change in the tube 3, resulting from the pressing by the pressure roller 7 from the position X to Y, whereby the ink is sucked from the recording head. After said sucking operation, the guide roller 6 is rotated further in the direction a, whereby the pressure roller 7 is gradually separated from the tube 3, along a roller guide 66 at the downstream side. The movement of the pressure roller 7 in this state is substantially inverse to the above-explained state of coming into contact with the tube 3, whereby the roller 7 is released from the tube 3. Since the roller 7 is released from the tube pressing state, the driving torque of the tube pump 4 is momentarily lowered.

The ink is sucked from the discharge openings 52 of the recording head 1 by the above-explained sucking operation by negative pressure, and the sucked ink is forwarded through the tube toward the used ink reservoir 11 and stored therein. The above-explained operations are detected by a sensing projection 67 formed on the guide roller 6 and a sensor 68 provided on the pump base 5, and the pressure roller is positioned according to the result of said detection.

In the present embodiment, the timing of start of contact of the pressure roller 7 with the tube 3 and/or the timing of end of said contact is made respectively different in plural tubes and plural rollers. This can be achieved in the following manner for plural pressure rollers 7 ( *7a*, *7b*, *7c*, *7d*).

Referring to FIG. 5, the distance from the E-ring stopper 43 of the roller bearing 80 supporting the pressure roller 7 to the center of the bearing for the shaft 38 of the pressure roller 7 is made different respectively for the pressure rollers *7a*, *7b*, *7c*, *7d* so as to satisfy a relation $h_a < h_b < h_c < h_d$. In the present embodiment, all the pressure rollers *7a*–*7d* have a same external diameter. Consequently the distance H from said stopper of the roller bearing 80 to the front end of the pressure roller 7 is different for the respective rollers 7. In the present embodiment, said distances for the pressure rollers *7a*–*7d* satisfy a relation $H_a < H_b < H_c < H_d$.

Figure 7:
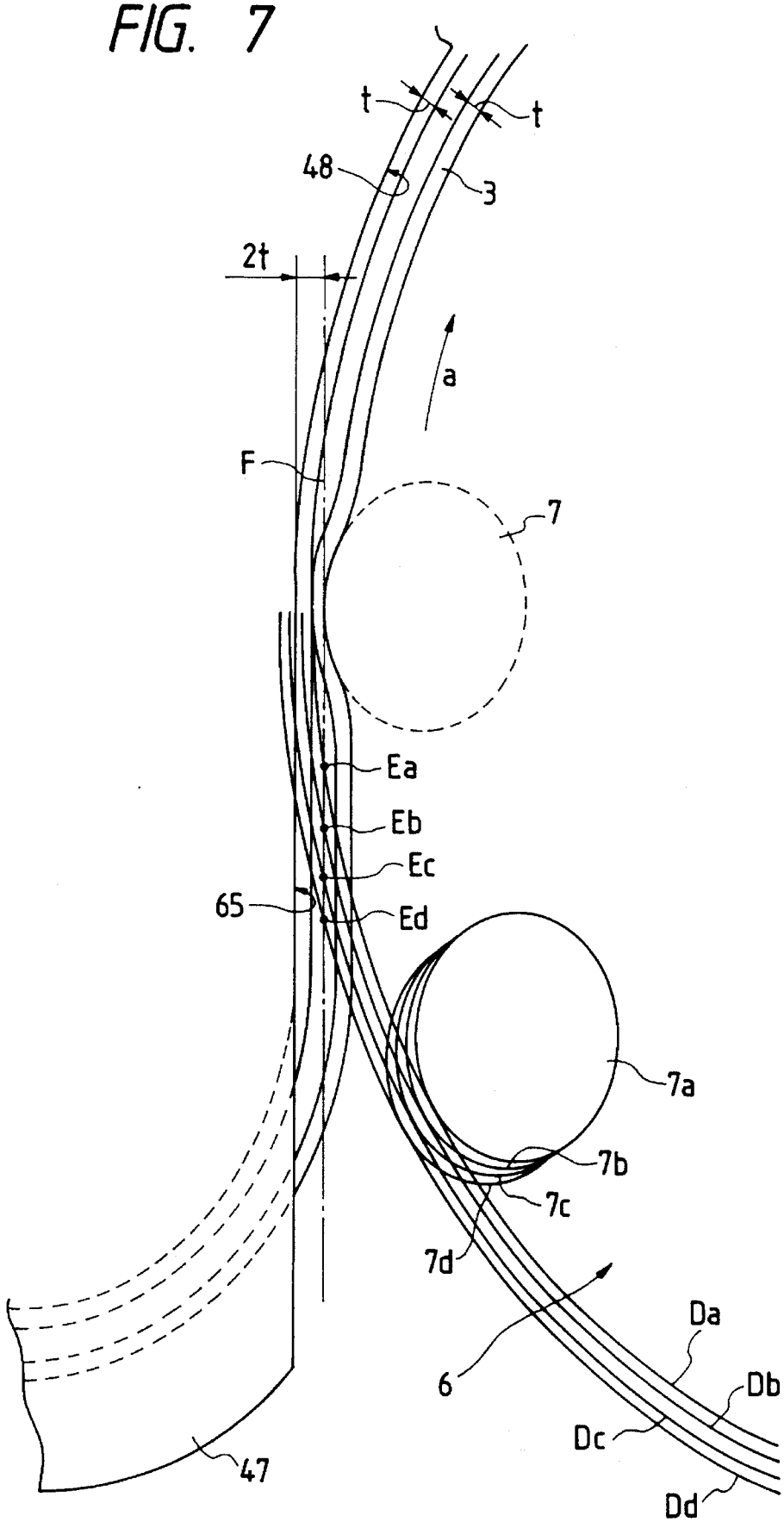
FIG. 7 is a schematic view showing the details of the tube pressing function of the pressure roller in an embodiment of the tube pump of the present invention.

FIG. 7 is a partial magnified view, showing the timings of the entry of plural pressure rollers into the roller guide 65. In order that the pressure roller 7 crushes the tube 3 of a thickness t to a state of zero internal volume, the gap between the roller 7 and the roller guide has to be equal to or less than *2t*. Also since the tube 3 is crushed to twice of the thickness or less, a reactive force is abruptly applied to the pressure roller 7.

In FIG. 7, lines $D_a$–$D_d$ indicate trajectories of the front ends of the pressure rollers $7_a$– $7_d$ when they move in a direction a, and points $E_a$–$E_d$ indicate crossing points of said trajectories with a line F spaced by *2t* from the roller guide 65. As indicated by said crossing points, the timings of reactive forces received by the pressure rollers $7_a$–*7d* from the tubes 3 are different from tube to tube. Stated differently, the increase in the pump driving torque, generated by said reactive force, is dispersed among the pressure rollers $7_a$–$7_d$.

Also the timings of release of the pressure rollers $7_a$–$7_d$ from the tubes 3 are different from roller to roller, so that the variation in the pump driving torque at said release can be similarly dispersed. Thus, since the peak torque is aberrated from tube to tube, the maximum load torque applied to the driving motor can be significantly reduced in comparison with a case in which the peak torques appear at the same time. Also the variation of the torque to the maximum value can be made gradually.

In order that a same suction intensity is applied to all the discharge openings 52, the distance from the cap 2 to the point ($E_a$–$E_d$ in FIG. 7) where the pump function is started by the crushing of the tube 3 by the pressure roller 7 is maintained constant for all the tubes 3.

In the above-explained embodiment, at the ink suction from the recording heads 1 by pressing the plural tubes 3, communicating with the discharge openings 52 of plural recording heads 1, the timings of start of pressing of the tubes 3 by the pressure rollers 7 and the timing of end of such pressing are made different from tube to tube. Consequently, even in case of ink suction from plural recording heads 1 with plural tubes 3, the driving motor can be made compacter and more inexpensively, through dispersion of the load torque. Also the torque variation to the maximum value can be made in gradual manner, by dispersing the torque variation at the start of tube pressing or at the end of said tube pressing, whereby the synchronization failure in the motor can be prevented. It is thus rendered possible to use the driving power source for sheet feeding or carriage driving also for the tube pump 4, without unevenness in the sheet feeding precision or in the main scanning operation, thereby achieving compactization and cost reduction of the recording apparatus.

Figure 8:
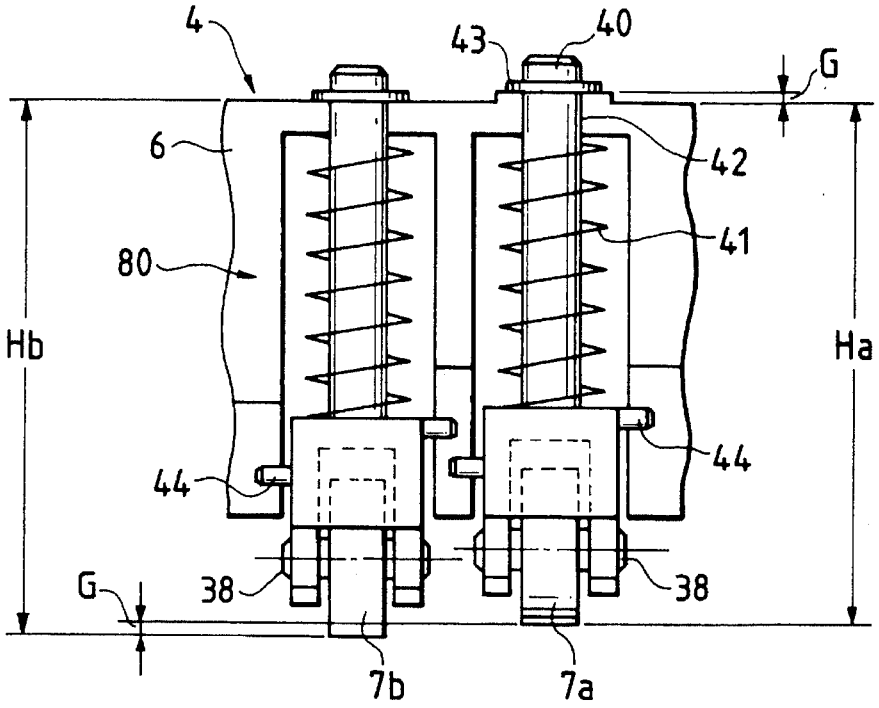
FIG. 8 is a partial elevation view showing the principal part of another embodiment of the tube pump.

In the foregoing embodiment, the distances $h_a$–$h_d$ from the stoppers of the roller bearings 80 to the center of bearing for the shafts 38 of the pressure rollers $7_a$–$7_d$ are varied in order to vary the timings of start of pressing of the tubes 3 by the pressure rollers 7 and those of release of the rollers 7 from the tubes 3, but it is also possible, as shown in FIG. 8, to form the plural pressure rollers $7_a$, $7_b$ and the roller bearings 80 therefor with a same size, and to alter the form of the impinging portion of the guide roller 6 supporting these components, between the pressure rollers $7_a$ and $7_b$. As shown in FIG. 8, a longer impinging portion, by a length G, at the side of roller $7_a$ realizes the distance $H_a$ to the front end of said roller $7_a$ to be shorter, by the length G, than that of the roller $7_b$. In this manner an effect similar to that in the foregoing embodiment can be achieved, under a relation $H_b = H_a + G$.

Figure 9:
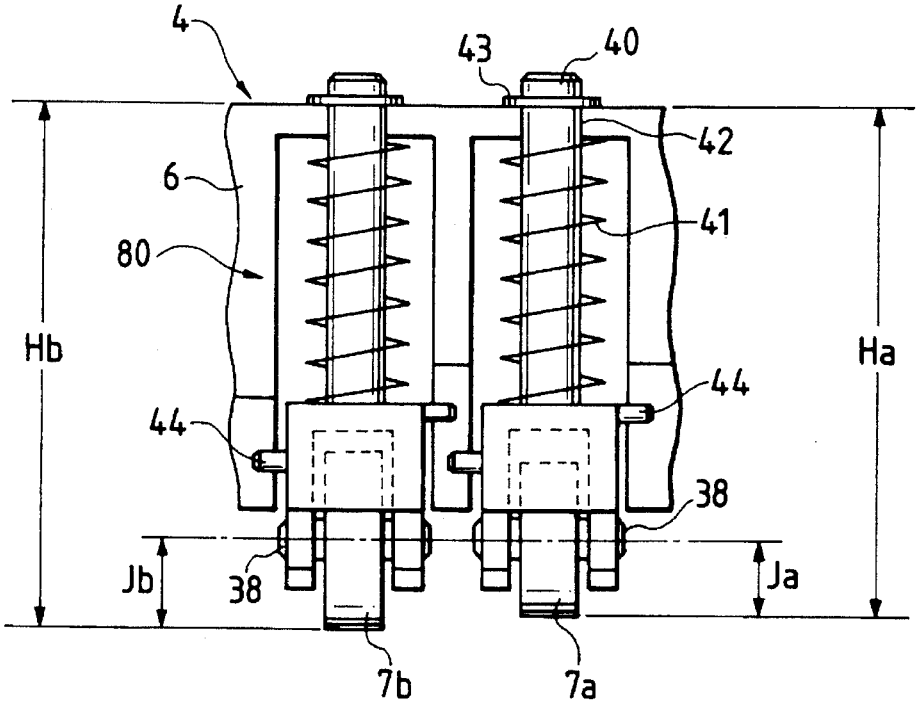
FIG. 9 is a partial elevation view showing the principal part of still another embodiment of the tube pump.

It is furthermore possible to achieve a similar effect, by maintaining a same dimension for thee impinging portions of the guide roller 6 and the roller bearings 80 for the pressure rollers *7a*, $7_b$ but adopting different external diameters thereof, as shown in FIG. 9. By forming a relation $J_b - J_a = G$ between the radii $J_a$, $J_b$ of the pressure rollers $7_a$, *7b*, a similar effect can be attained as in the embodiment shown in FIG. 8, under the relation $H_b = H_a + G$.

Figure 10:
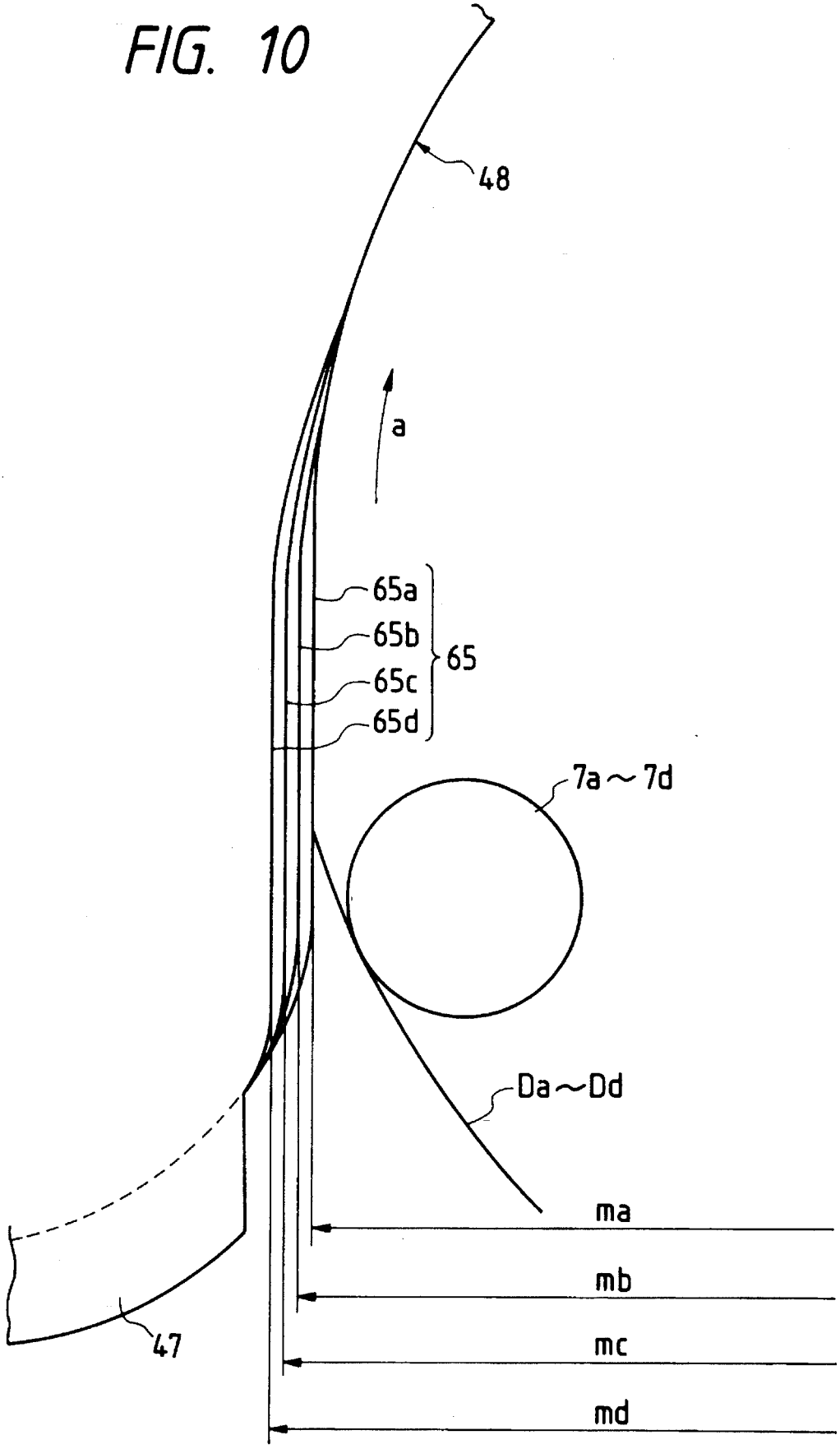
FIG. 10 is a partial magnified view showing the principal part of the another embodiment of the tube pump.

It is furthermore possible to achieve an effect similar to that in the foregoing embodiments, by maintaining the pressure rollers *7a*, *7b*, *7c*, *7d*, their roller bearings 80 and the impinging portions of the guide roller 6 constant and varying the distance $m_a$, $m_b$, $m_c$, $m_d$ from the center of the arc-shaped roller guide 48 of the pump base 5 to the roller guides 65 (or 66) as shown in FIG. 10. More specifically, it is possible to vary the timings of the pressing of the tubes 3 by the pressure rollers *7a*, *7b*, *7c*, $7_d$, by forming the roller guides $63_a$, $65_b$, $65_c$, $65_d$, respectively corresponding to the pressure rollers $7_a$ , $7_b$ , $7_c$, $7_d$ in such a manner that the distances $m_a$, $m_b$, $m_c$, $m_d$ from the center of the arc-shaped roller guide 48 to said respective roller guides satisfy a relation $m_a<m_b<m_c<m_d$.

Figure 11:
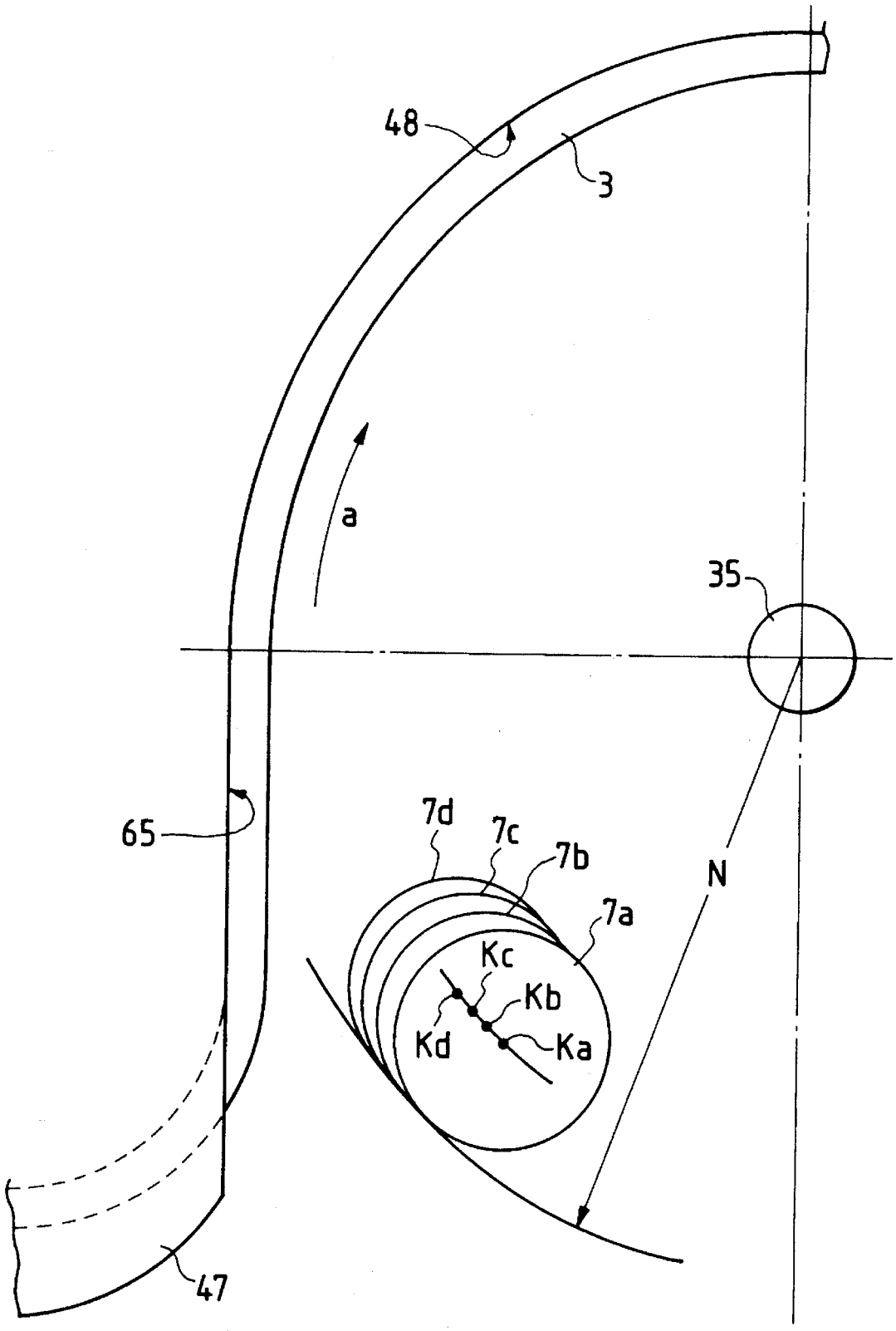
FIG. 11 is a partial magnified view showing the principal part of still another embodiment of the tube pump.

It is furthermore possible to attain a similar effect by forming the roller guides 65 corresponding to the pressure rollers $7_a$–$7_d$ in a same shape by varying the relative positions of the pressure rollers $7_a$–$7d$, as shown in FIG. 11. More specifically, as shown in FIG. 11, the distances from the center of the shaft 35 of the guide roller 6 to the front ends of the pressure rollers $7_a$–$7_d$ are same (dimension N) but the rotary centers $K_a$, $K_b$, $K_c$, $K_d$ of the rotary centers of said rollers are mutually aberrated according to a predetermined relationship. Such configuration also allows to vary the timings of pressing of the tubes 3 by the pressure rollers $7_a$–$7_d$.

Figure 12:
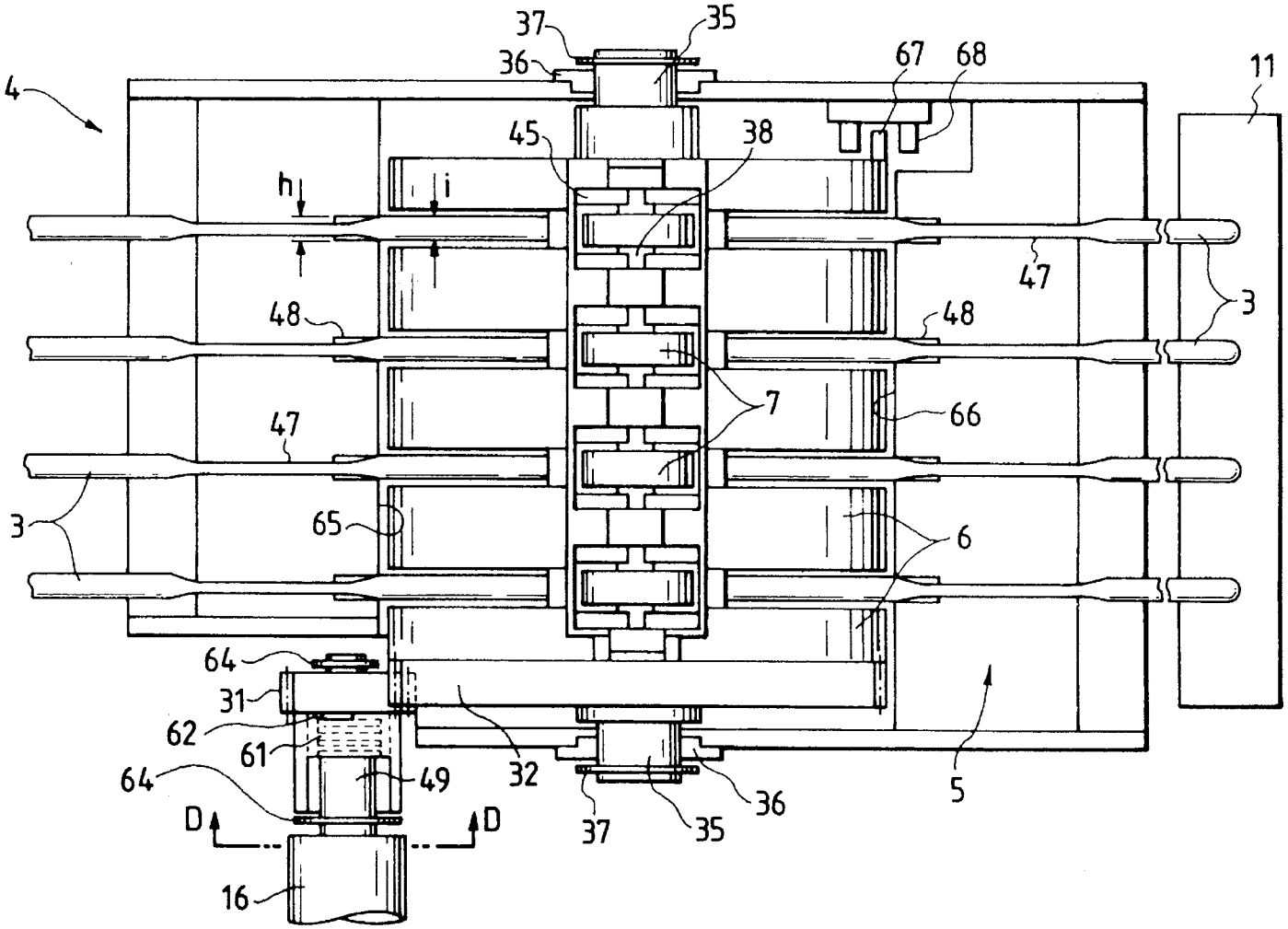
FIG. 12 is a plan view showing another embodiment of the suction device of the present invention.
Figure 13:
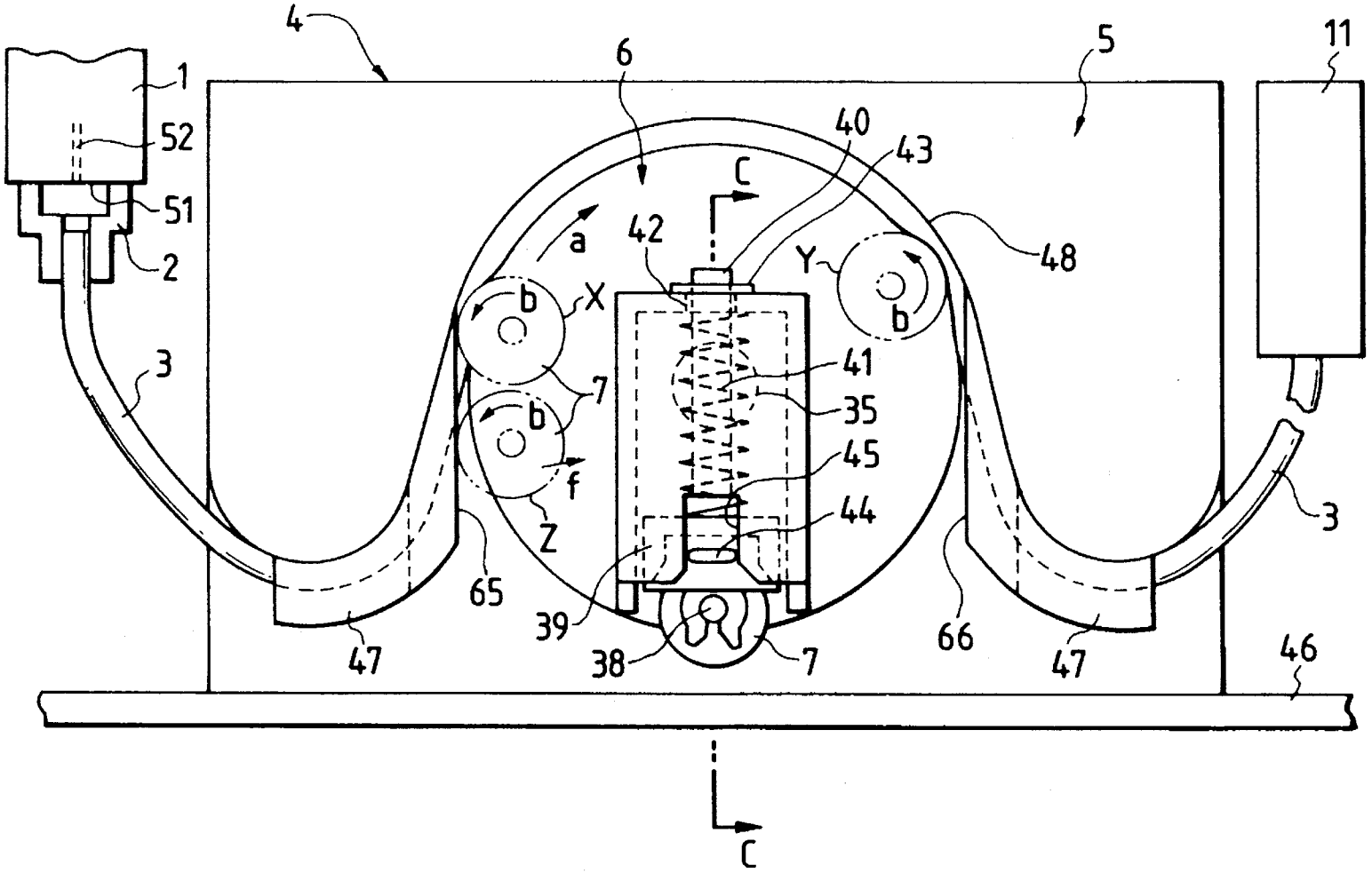
FIG. 13 is a vertical cross-sectional view of said device shown in FIG. 12.
Figure 14:
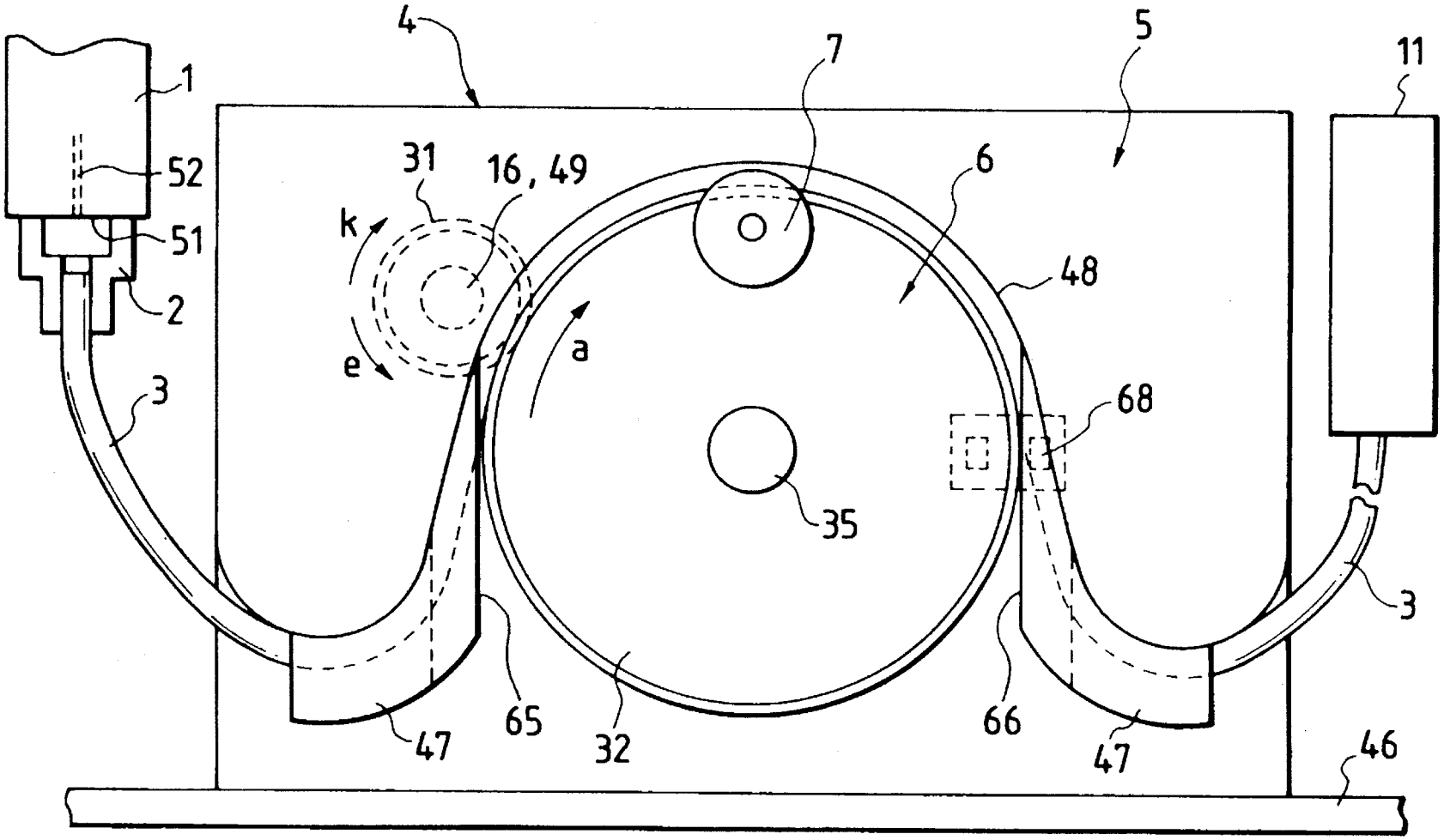
FIG. 14 is a vertical cross-sectional view of the function of said device shown in FIG. 12.
Figure 15:
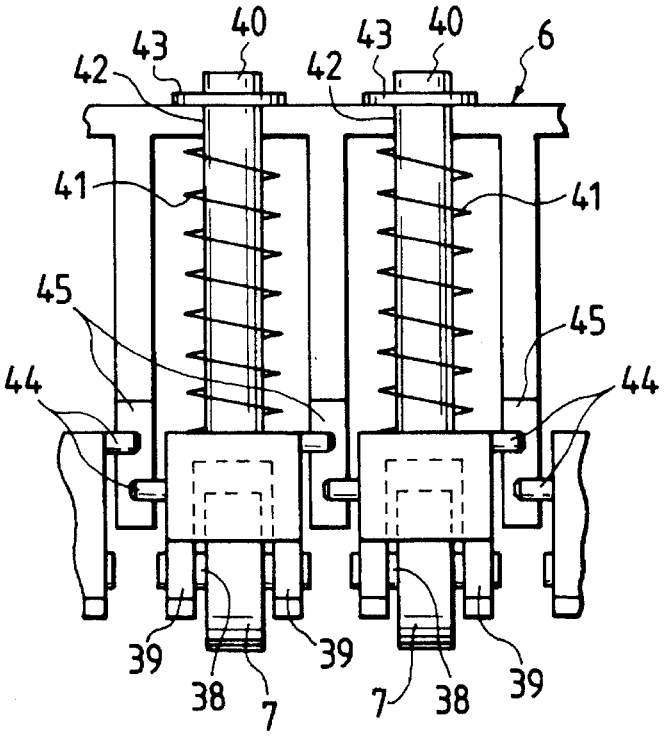
FIG. 15 is a partial cross-sectional view along a line C—C in FIG. 13.
Figure 16:
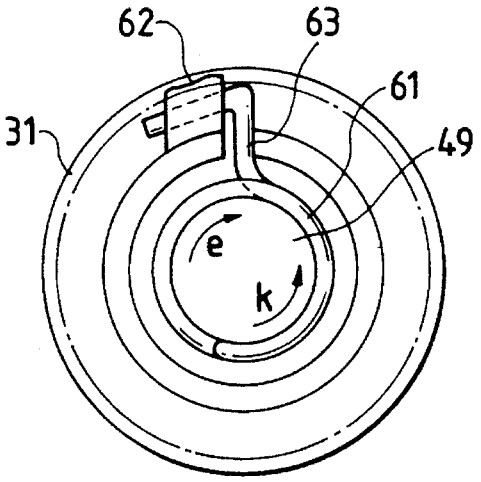
FIG. 16 is an elevation view of a one-way mechanism seen from a line D—D in FIG. 12.
Figure 17:
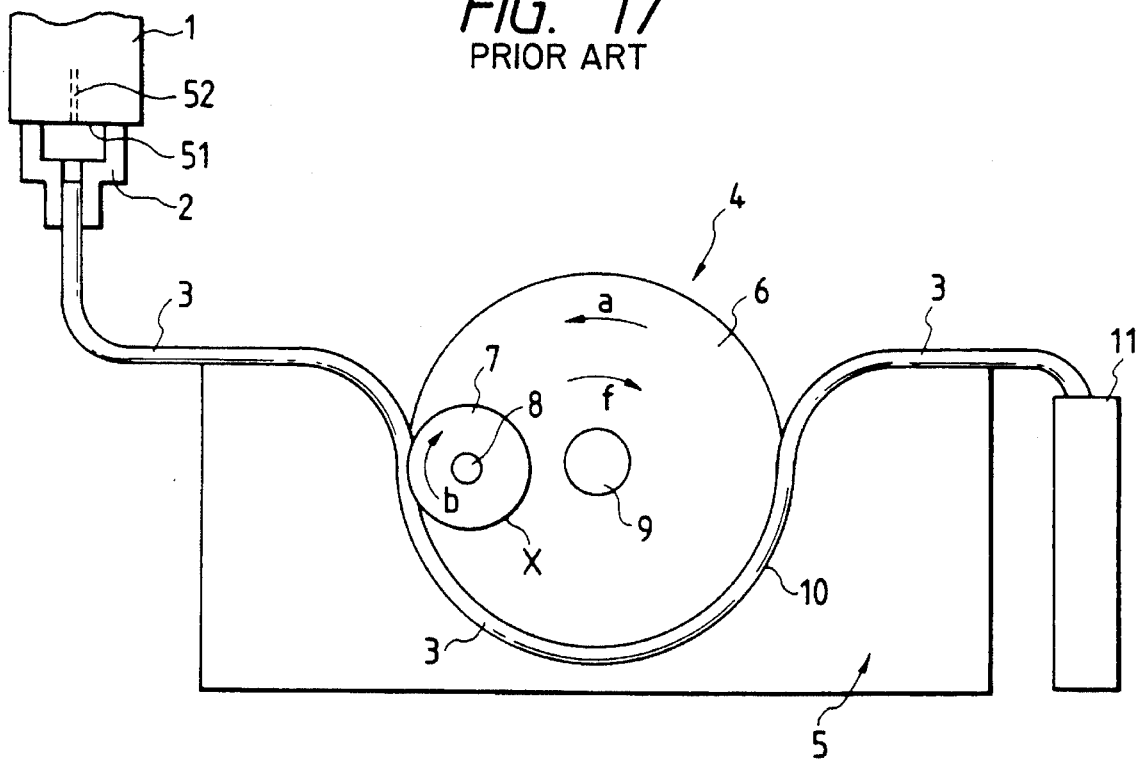
FIG. 17 PRIOR ART
FIG. 17 is a schematic lateral view showing the state of a tube pump at the start of tube pressing.
Figure 18:
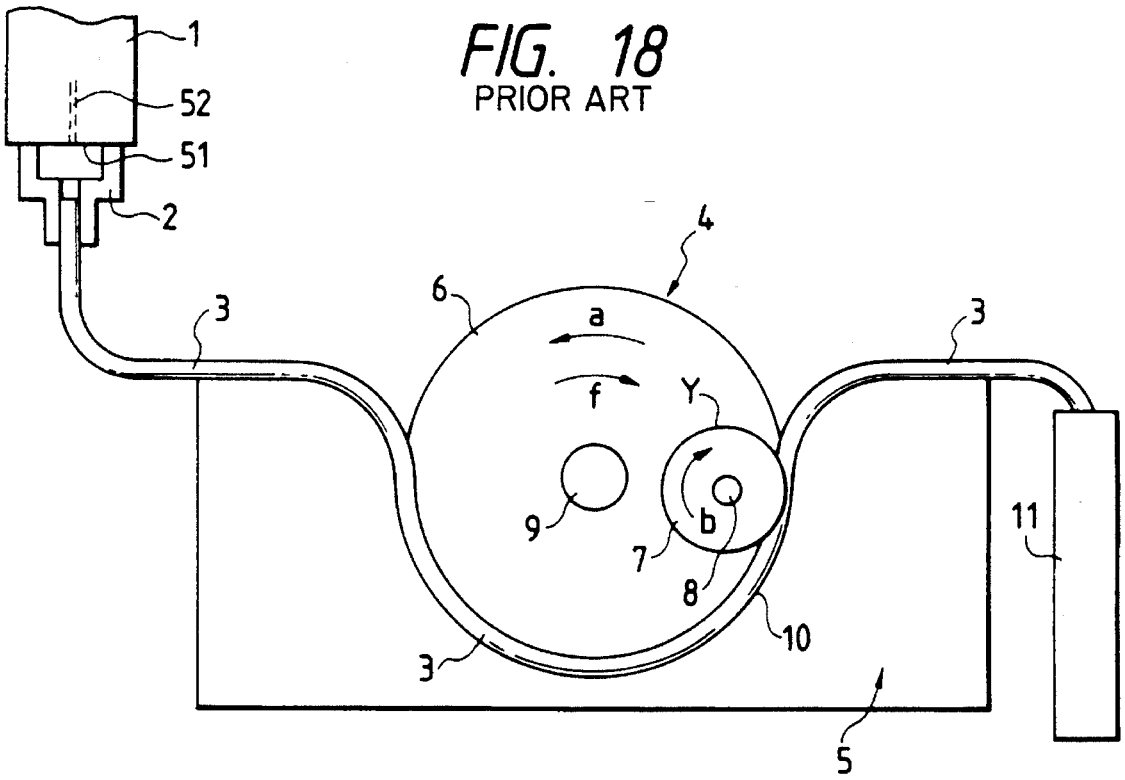
FIG. 18 PRIOR ART
FIG. 18 is a schematic lateral view showing the state of a tube pump at the end of tube pressing.

FIG. 12 is a plan view of another embodiment of the tube pump; FIG. 13 is a vertical cross-sectional view thereof; FIG. 14 is a vertical cross-sectional view showing the function thereof; FIG. 15 is a partial cross-sectional view along a line C—C in FIG. 13; and FIG. 16 is an elevation view of a one-way clutch, seen from a line D—D in FIG. 12.

In case the discharge openings 52 of the recording heads 1 are blocked or are anticipated to be blocked, the discharge recovery operation by suction is conducted at a non-recording position, usually the home position HP.

In the non-recording position, the apertures of the caps 2 are brought into contact with the discharge opening faces 51 of the recording heads 1, thereby closing the discharge openings. Flexible tubes 3, connected to rear holes of the caps 2 extend to the tube pump 4. Said tube pump 4 is composed of a pump base 5 rotatably supporting a guide roller 6, which in turn rotatably supports pressure rollers 7. In the present embodiment, corresponding to the number (four) of the recording heads 1, there are provided four sets of the cap 2, tube 3, pressing roller 7 and supporting mechanism therefor, as shown in FIG. 12.

Referring to FIGS. 12 to 15, the shaft 35 of the guide roller 6 is rotatably mounted in a bearing 36 of the pump base 5, and an E-ring 37 is mounted for maintaining said shaft 35 in the bearing 36. The pressure roller 7, for pressing the tube 3, is rotatably supported by a shaft 38 thereof fitted in a roller bearing 39. Said roller bearing 39 is mounted, together with a vertical shaft 40 and a compression spring 41, in a hole 42 formed in the guide roller 6, and is maintained in position by an E-ring 43. Said pressure roller is biased by said compression spring 41 in a direction to press the tube 3.

The roller bearing 39 is positioned by positioning pins 44 thereof being guided by guide grooves 45 formed in the guide roller 6, and by the aforementioned vertical shaft 40 being guided by a guide hole 42 of the guide roller 6. In order to minimize the space of the tube pump 4, the positioning pins are alternated in height, as shown in FIG. 15, and are overlappingly positioned in the guide grooves 45.

Said pump base 5 is provided with an arc-shaped groove 413 concentric with the shaft 35 of the guide roller 6. The pump base 5 is mounted to the base 46 of the apparatus, in such a manner that the apertures of the arc-shaped groove 48 are positioned downwards. In this manner the pump base 5 functions as a cover, enclosing the moving parts when said pump base 5 is mounted, thereby preventing eventual contact of the user with or intrusion of foreign matter into the moving parts. The tube 3 is pinched and fixed in tube fixing grooves 47, formed in front of and behind the guide roller 6 on the pump base 5. The downstream end of said tube 3 is connected to a used ink reservoir 11, for storing the ink sucked out of the discharge openings 52.

Referring to FIGS. 12, 13 and 14, a coil-shaped clutch spring 61 and the aforementioned driving gear 31 are fitted on a shaft 49 at the end of said transport roller 16 (FIG. 1). Said driving gear is rotatably supported on the shaft 49, and the clutch spring 61 is limited in the thrust direction, by a projection 62 of the driving gear 31. Also the internal diameter of the clutch spring 61 is smaller than the external diameter of the shaft 49, thereby having a suitable tightening effect. When the transport roller 16 is rotated in a direction e, the clutch spring 61 is tightened on the shaft 49 and rotates in said direction e, together with the transport roller 16. In this case the L-shaped bent end, shown in FIG. 16, of the clutch spring 61 impinges on a stopper 63 of the driving gear 31, whereby the rotation of the transport roller 16 is transmitted to the driving gear 31, then to the driven gear 32 fixed on the shaft 35 of the guide roller 6, and the pressure roller 7 is therefore driven in the forward direction a shown in FIGS. 13 and 14.

On the other hand, when the transport roller 16 is rotated in a direction k, the spring 61 is loosened on the shaft 49 of the transport roller 16. In this state the transport roller 16 and the clutch spring 61 mutually slip with a certain non-zero slipping torque, which is equal to the torque when the shaft 49 starts to slip with respect to the clutch spring 61 in the rotation in said loosening direction. Consequently, when the transport roller 16 rotates in the direction k, and if the reversing torque (in a direction opposite to the direction a in FIGS. 13 and 14) of the tube pump 4 is larger than the above-mentioned slipping torque, the clutch spring 61 and the shaft 49 mutually slip, so that the rotation of the transport roller 16 is not transmitted to the driving gear 31, and the pressure roller 7 does not receive the rotary driving force in the reverse direction. In the present embodiment, the reverse torque of the tube pump 4 is selected larger than said slipping torque, so that the driving force in the reverse direction is not transmitted to the pressure roller 7. Said clutch spring 61 therefore constitutes a one-way clutch. On said shaft 49, there is mounted a stopper 64 for maintaining the driving gear 31 in position.

In the above-explained structure, when the transport roller 16 is rotated by the transport motor (FIG. 1)in the sheet advancing direction (forward direction e), the guide roller 6 is rotated in the direction a through the gears 31 and 32. In the present embodiment the rotation of the transport roller 16 is transmitted to the guide roller 6, but the driving force therefor may be obtained from another roller of the recording material transporting system or from another rotary part or driving power source of the recording apparatus. Upon rotation of the guide roller 6 in the direction a, the pressure roller 7 supported thereon comes into contact with a roller guide 65, formed integrally with the tube fixing groove 47 at the upstream side of the pump base 5, as indicated by a position Z in FIG. 13. The pressure roller 7, being guided by the roller guide 65, moves in a direction f while rotating in a direction b until it reaches a pressing position for the tube 3.

Upon further rotation of the guide roller 6 in the direction a, the pressure roller 7 comes into contact with the tube 3 at the position X, while rotating in the direction b, and crushes the tube until the internal space thereof becomes zero. In the course of movement (revolution) from Z to X, since the pressure roller 7 has already moved, at the position Z, in a direction f to a tube pressing state, the increase of pressure acting on the pressure roller 7 at the position X is maintained within a certain range. Thus the pressure roller 7 gradually presses the tube 3 along the roller guide 65, and the fluctuation in torque applied to the transport roller 16 when the pressure roller comes into contact with the tube 3 can be made very small.

Said tube fixing groove 47 has a larger width in the vicinity of said roller guide 65, in order to prevent, at the start of contact of the pressure roller 7 with the tube 3, the reactive force of thus deformed tube from being transmitted to the pressure roller 7. More specifically, the external diameter of the tube 3 in a smaller groove width h in the vicinity of the roller guide 65 is preferably made larger than that in a larger groove width i where said tube 3 is pressed by the pressure roller 7. However, since the arc-shaped groove works also as the roller guide 65, the width h of said groove has to be made smaller than the thickness g of the pressure roller 7.

Upon further rotation of the guide roller in the direction a, the pressure roller 7 moves with the rotation in the direction b, while crushing the tube 3, and the pressure roller 7 temporarily stops at a position Y shown in FIG. 13. In this state a negative pressure is generated at the discharge openings 52 of the recording head 1, because of the volume change in the tube 3, resulting from the pressing by the pressure roller 7 from the position X to Y, whereby the ink is sucked from the recording head. After said sucking operation, the guide roller 6 is further rotated in the direction a, whereby the pressure roller 7 is gradually separated from the tube 3, along a roller guide 66 at the downstream side. The movement of the pressure roller 7 in this state is substantially inverse to the above-explained state of coming into contact with the tube 3. Consequently the fluctuation in torque when the pressure roller 7 is released from the tube 3 in pressed state can also be made very small.

The ink is sucked from the discharge openings 52 of the recording head 1 by the above-explained sucking operation, and the sucked ink is forwarded through the tube toward the used ink reservoir 11 and stored therein. The above-explained operations are detected by a sensing projection 67 formed on the guide roller 6 and a sensor 68 provided on the pump base 5, and the pressure roller is positioned according to the result of said detection.

In the embodiment shown in FIGS. 12 to 16, because of the presence of the one-way clutch consisting of the clutch spring 61 on the shaft 49 of the transport roller 16, the rotating force is transmitted to the guide roller 6 to effect the above-explained sucking operation when the transport roller 16 is rotated in the forward direction e, but, in case the transport roller 16 is rotated inversely in the direction k, the rotating force thereof is not transmitted to the driving gear 31, so that the guide roller 6 is not rotated. Consequently the reverse driving force is not transmitted to the pressure roller 7, so that the inverse flow of the ink in the tube 3, as explained in the conventional configuration, does not take place.

Also in case the transport roller 16 is rotated in the reverse direction k, there will result a certain slipping torque is generated between the clutch spring 61 and the shaft 49. In the present embodiment, the home position of the pressure roller 7 is selected in a non-pressing area for the tube 3, while the slipping torque of the clutch spring 61 is selected within a range of 40 to 200 g.cm, and the reverse driving torque of the tube pump 4 (driving torque at the start of pressing of the tube 3 by the pressure roller 7) is selected within a range of 250 to 650 g.cm. Thus, when the transport roller 16 is rotated in the reverse direction k, the pressure roller 7 effects revolution until it comes into contact with the tube 3, but is stopped in this position because the torque required for the pressure roller 7 to start pressing is larger than the slipping torque. Consequently there is not generated a positive pressure, causing the ink reverse flow from the tube 3 to the recording head 1. In this state, the clutch spring 61 slips on the shaft 49.

In the above-explained embodiment provided with a tube pump 4 for ink discharge recovery by suction, utilizing the deformation of a tube, wherein the driving power source for said tube pump is capable of forward and reverse rotation, the driving force is transmitted to the pressure roller 7 for deforming the tube 3 only in the forward rotation which applies a negative suction pressure to the recording head. It is therefore rendered possible to prevent the reverse flow of ink at the tube pump 4, thereby avoiding the ink overflow from the caps 2, ink deposition on the discharge opening face 51 or intrusion of used ink into the discharge openings 52, thus improving the quality of the recorded image. Also the absence of reverse drive reduces the amount of rotation of the tube pump 4, thereby extending the service life of the tube 3 and improving the reliability of the pump. Furthermore the use of a spring clutch provides a one-way mechanism which is compact, light in weight and simple in structure.

In the foregoing embodiment, the tube pump 4 is driven by the transport roller, namely by the driving power source of the recording material transport system, but it may also be driven by another driving power source in the recording apparatus such as the carriage motor for causing serial scanning motion of the recording heads. Also in such case, a one-way mechanism is provided between the driving power source and the tube pump 4.

Also the foregoing embodiment employs a one-way mechanism utilizing the clutch spring 61, but there may be employed other clutches with a one-way function. Also there may be employed a solenoid clutch or a ratchet mechanism as long as the forward driving force alone is transmitted to the tube pump 4. Furthermore, said one-way mechanism is provided on the shaft 49 of the transport roller 16 in the foregoing embodiment, but said one-way mechanism may also provided in the pump 4 itself, or in the transmission mechanism from the driving power source to the pressure roller 7. Furthermore, the combination of the foregoing embodiments will provide effects in mutually multiplying manner.

In the foregoing embodiments there have been explained examples of the ink jet recording apparatus utilizing plural recording means 1 with inks of different colors, but the present invention is likewise applicable to and can attain similar effects in other ink jet recording apparatus, such as that for gradation recording, employing plural recording means with inks of a same color and dirrerent densities, as long as there provided plural recording means and plural ink sucking tubes.

Also in the foregoing embodiments, there have been explained serial recording apparatus in which the recording means 1 is mounted on the carriage 24, but the present invention is likewise applicable to and can attain similar effect in a line type apparatus which employs line type recording means of a length covering the entire width of the recording material 12 or a part thereof and forming a record solely by the sub scanning operation. Also the recording means 1 is not limited to the cartridge type in which the ink discharge unit (recording head) is integrated with the ink tank, but can also be of a configuration in which an ink discharge unit and an ink tank are separated and are mutually connected through an ink supply tube, and the present invention is likewise applicable to and can attain similar effects regardless of the configuration of the recording means.

The present invention is applicable to various ink jet recording apparatus, such as that employing recording means which utilizes electromechanical converters such as piezoelectric elements, but provides a particularly excellent effect in an ink jet recording apparatus utilizing ink discharge by thermal energy, because such recording method can achieve a higher density and a finer definition of the recorded image.

It is preferable to employ the typical structure and the principle of structures disclosed in, for example, U.S. Pat. Nos. 4,723,129 and 4,740,796. This system can be adopted in a so-called "On-Demand" type and "Continuous" type structures. In this system, an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nucleate boiling point, so that thermal energy is generated in the electrothermal conversion member and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge port, so that at least one droplet is formed. In a case where the aforesaid drive signal is made to be a pulse signal, a further satisfactory effect can be obtained in that the bubble can immediately and properly be enlarged/contract and liquid (ink) can be discharged while exhibiting excellent responsibility. It is preferable to employ a drive signal of the pulse signal type disclosed in U.S. Pat. Nos. 4,463,359 and 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid patent specifications, a structure disclosed in U.S. Pat. Nos. 4,558,333 and 4,459,600 in which the heated portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Laid-Open No. 59-123670 and a structure in which an opening for absorbing thermal energy pressure wave is formed to align to the discharge port and which is disclosed in Japanese Patent Laid-Open No. 59-138461. Stated differently, the present invention enables secure and efficient recording, regardless of the configuration of the recording head.

The present invention is effectively applicable also to a full-line type recording head, of a length corresponding to the maximum width of the recording material that can be accommodated in the recording apparatus. Such recording head may be obtained by plural recording heads so combined as to provide the required length, or may be constructed as a single integrated recording head. Also within the above-mentioned serial type apparatus, the present invention is effective for a recording head fixed in the recording apparatus, a recording head of interchangeable chip type, which can receive ink supply from the main apparatus and can be electrically connected therewith upon mounting on said main apparatus, or a recording head of cartridge type in which an ink cartridge is integrally constructed with the recording head.

Also the recording apparatus is preferably provided with the discharge recovery means and other auxiliary means for the recording head, since the effects of the recording head of the present invention can be stabilized further. Examples of such means for the recording head include capping means, cleaning means, pressurizing or suction means, preliminary heating means composed of electrothermal converter element and/or another heating device, and means for effecting an idle ink discharge independent from the recording operation, all of which are effective for achieving stable recording operation.

With respect to the kind and number of the recording heads, there may be employed only one head corresponding to ink of a single color, or plural heads corresponding to plural inks different in color or in density. Thus the present invention is not limited to a recording mode for recording a single main color such as black, but is extremely effective also to the recording head for recording plural different colors or full color by color mixing, wherein the recording head is either integrally constructed or is composed of plural units.

Furthermore, the foregoing embodiments employ liquid ink, but the present invention is applicable also to ink which is solid below room temperature but softens or liquefies at room temperature, or which softens or liquefies with a temperature control range from 30° C. to 70° C., which is ordinarily adopted in the ink jet recording. Thus the ink only needs to be liquidous when the recording signal is given. Besides the present invention is applicable to ink liquefiable by thermal energy provided corresponding to the recording signal, such as the ink in which the temperature increase by thermal energy is intentionally absorbed by the state change from solid to liquid, or the ink which remains solid in the unused state for the purpose of prevention of ink evaporation, or the ink which starts to solidify upon reaching the recording material.

In these cases the ink may be supported as solid or liquid in recesses or holes of a porous sheet, is described in the Japanese Patent Laid-open Nos. 54-56847 and 60-71260, and placed in an opposed state to the electrothermal converter element. The present invention is most effective when the above-mentioned film boiling is induced in the ink of the abovementioned forms.

Furthermore, the ink jet recording apparatus of the present invention may be constructed as an image output terminal for an information processing apparatus such as a computer, a copying machine in combination with an image reader, or a facsimile apparatus with transmission-reception functions.

As will be apparent from the foregoing description, the ink jet recording apparatus of the present invention, for forming a record by discharging ink from recording means onto a recording material, is provided with a tube pump for ink discharge recovery by suction or pressurization, through deformation of plural tubes, communicating with the discharge openings of the recording means, by pressure rollers, wherein the timings of start of pressing of said tubes by the pressure rollers or the timings of end of said pressing are made different from tube to tube. Thus, even in the presence of plural tubes, the load torque at the pressing of said tube by the pressure rollers is dispersed, so that the driving motor can be made more compact, lighter in weight and lower in cost. Also the torque fluctuation at the moment of pressing of said tubes by said pressure rollers or at the moment of releasing of said tubes from said pressure rollers can be dispersed, so that the torque variation to a maximum value can be made in a gradual manner. It is therefore rendered possible to prevent desynchronization of the motor, thereby enabling to use the driving power source for sheet advancement or carriage drive also for the pump, without fluctuation in the precision of sheet feeding or in the main scanning operation. Therefore there can be provided an ink jet recording apparatus enabling reduction in size, weight and cost.

Furthermore, the ink jet recording apparatus of the present invention, for forming a record by discharging ink from the recording means onto the recording material, is provided with a tube pump for ink discharge recovery by generating a negative pressure at the discharge openings of the recording means, through deformation, by a pressure roller, of a tube communicating with said discharge openings, wherein the driving force is transmitted to the pressure roller only in such a direction as to generate the negative pressure at said discharge openings. Thus there is provided an ink jet recording apparatus equipped with a suction pump for ink discharge recovery, capable of preventing the reverse ink flow with a simple structure, thereby improving the image quality. Also the absence of reverse rotation of the pump improves the service life of the tube and reliability of the pump.

The above-mentioned effect can be attained more efficiently by adding a configuration of having a one-way clutch between the tube pump and the driving power source thereof, or a configuration having a transport roller between the driving power source and the tube pump, providing a clutch spring on the shaft of the transport roller and causing an end of the clutch spring to impinge on a part of a gear provided on the shaft, whereby the clutch spring is tightened to transmit the driving force to the tube pump when the transport roller is rotated in a direction to generate the negative pressure at the discharge openings but the clutch spring is so loosened as not to transmit the driving force to the tube pump when the transport roller is rotated in the opposite direction.

What is claimed is:

1. An ink jet recording apparatus for forming a record by discharging ink from a recording means for recording onto a recording material, the recording means having a plurality of discharge openings, the apparatus comprising:

more than three tube pumps for effecting an ink discharge recovery by causing at least one of suction and pressurization of said discharge openings of said recording means, each said tube pumps having;

a tube for communicating with a corresponding said discharge opening; and a pressure roller for deforming said tube by first pressing and releasing said tube at a predetermined timing; and deforming control means for controlling a timing with which said tube of said tube pumps are deformed by pressing and releasing, wherein the timing of the pressing of each said tube, or the timing of the releasing from pressing of each said tube, or the timing of both the pressing and the releasing from pressing of each said tube, is such that a time period of a pressure variation for recovery is substantially duplicated for each said tube, so that each said tube experiences a pressure change at approximately a same time, yet so that the pressure changes of each respective tube begin and end at slightly different times from one another.

2. An apparatus according to claim 1, wherein said recording means comprises an ink jet recording means for recording, said recording means having an electrothermal converter for generating thermal energy to be utilized for ink discharge.

3. An apparatus according to claim 2, wherein said recording means discharges ink from each of said discharge openings as a consequence of film boiling generated in the ink by the thermal energy generated by a corresponding said electrothermal converter.

4. An apparatus according to claim 1, further comprising driving means for driving each said pressure roller, wherein each said pressure roller is driven only in a direction that generates a negative pressure at said discharge openings.

* * * * *

UNITED STATES PATENT AND TRADEMARK OFFICE

CERTIFICATE OF CORRECTION

PATENT NO. : 5,486,854

DATED : January 23, 1996

INVENTOR(S) : Haruo Uchida

It is certified that error appears in the above-identified patent and that said Letters Patent is hereby corrected as shown below:

Item [57],

ABSTRACT

Line 3, "material," should read --material--.

COLUMN 1

Line 13, "process," should read --processor,--.
Line 30, "the" (second occurrence) should be deleted.
Line 43, "for" should be deleted.
Line 61, "projectors" should read --projectors)--.

COLUMN 2

Line 16, "details," should read --detail,--.
Line 49, "same" should read --the same--.

COLUMN 3

Line 26, "direction," should read --one direction,--.

UNITED STATES PATENT AND TRADEMARK OFFICE

CERTIFICATE OF CORRECTION

PATENT NO. : 5,486,854

DATED : January 23, 1996

INVENTOR(S) : Haruo Uchida

It is certified that error appears in the above-identified patent and that said Letters Patent is hereby corrected as shown below:

COLUMN 4

Line 32, "cross-sectional" should read --cross-sectional view--.

COLUMN 5

Line 44, "replaceable" should read --replaceably--.

COLUMN 6

Line 16, "28" should read --27-- and "29" should read --28--.
Line 65, "consists" should read --consist--.
Line 66, "strong" should read --storing--.

COLUMN 7

Line 60, "tube 3," should read --tubes 3,--.

COLUMN 9

Line 36, "7a, 7b, 7c, 7d" should read --$7_a$, $7_b$, $7_c$, $7_d$,--.
Line 41, "7a, 7b, 7c, 7d" should read --$7_a$, $7_b$, $7_c$, $7_d$,--.
Line 42, "7a-7d" should read --$7_a$-$7_d$--.
Line 47, "7a-7d" should read --$7_a$-$7_d$--.
Line 61, "$7_a$-7d" should read --$7_a$-$7_d$--.

UNITED STATES PATENT AND TRADEMARK OFFICE

CERTIFICATE OF CORRECTION

PATENT NO. : 5,486,854

DATED : January 23, 1996

INVENTOR(S) : Haruo Uchida

It is certified that error appears in the above-identified patent and that said Letters Patent is hereby corrected as shown below:

COLUMN 10

Line 17, "timing" should read --timings--.
Line 49, "thee" should read --the--.
Line 51, "7a" should read --$7_a$--.
Line 58, "7a, 7b, 7c, 7d" should read --$7_a$, $7_b$, $7_c$, $7_d$--.
Line 65, "7a, 7b, 7c," should read --$7_a$, $7_b$, $7_c$,--.
Line 66, "$63_a$," should read --$65_a$,--.

COLUMN 11

Line 9, "same" should read --the same--.
Line 58, "413" should read --48--.

COLUMN 12

Line 42, "1)in" should read --1) in--.

COLUMN 13

Line 57, "is" should be deleted.

UNITED STATES PATENT AND TRADEMARK OFFICE

CERTIFICATE OF CORRECTION

PATENT NO. : 5,486,854

DATED : January 23, 1996

INVENTOR(S) : Haruo Uchida

It is certified that error appears in the above-identified patent and that said Letters Patent is hereby corrected as shown below:

COLUMN 14

Line 41, "provided" should read --be provided--.
Line 52, "dirrerent" should read --different--.

COLUMN 15

Line 44, "patent specifications," should read --patents,--.

COLUMN 16

Line 34, "liquidous" should read --liquid--.

UNITED STATES PATENT AND TRADEMARK OFFICE

CERTIFICATE OF CORRECTION

PATENT NO. : 5,486,854

DATED : January 23, 1996

INVENTOR(S) : Haruo Uchida

It is certified that error appears in the above-identified patent and that said Letters Patent is hereby corrected as shown below:

COLUMN 18

Line 11, "and" should be deleted.
Line 15, "are" should read --is--.

Signed and Sealed this

Eighth Day of October, 1996

*Attest:*

*Attesting Officer*

BRUCE LEHMAN

*Commissioner of Patents and Trademarks*